US006353376B1

(12) United States Patent
Takeuchi et al.

(10) Patent No.: US 6,353,376 B1
(45) Date of Patent: Mar. 5, 2002

(54) SWITCHING ASSEMBLY

(75) Inventors: Toshie Takeuchi; Toshiyuki Yoshizawa; Hiroyuki Akita; Hiroyuki Sasao; Yukimori Kishida, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/472,825

(22) Filed: Dec. 28, 1999

(30) Foreign Application Priority Data

Dec. 28, 1998 (JP) ..... 10-373409
Dec. 6, 1999 (JP) ..... 11-346420

(51) Int. Cl.[7] ..... H01H 53/00
(52) U.S. Cl. ..... 335/147; 335/148; 335/223; 218/141
(58) Field of Search ..... 335/100, 147–150, 335/223–226, 240; 218/120, 141, 142

(56) References Cited

U.S. PATENT DOCUMENTS 4,086,645 A 4/1978 Gorman et al. ..... 361/155
5,175,403 A * 12/1992 Hamm et al. ..... 335/240
5,207,410 A * 5/1993 Wakeman ..... 251/129.15
6,295,191 B1 9/2001 Kishida et al.

FOREIGN PATENT DOCUMENTS

DE 3910010 A1 3/1989

* cited by examiner

*Primary Examiner*—Ramon M. Barrera
(74) *Attorney, Agent, or Firm*—Leydig, Voit & Mayer, Ltd.

(57) ABSTRACT

A switching assembly includes a switch portion having a fixed electrode and a movable electrode which are separable, a movable portion secured between a movable shaft connected to the movable electrode and a movable coil by a magnetic body, and a fixed portion having a magnetic body disposed radially inside a fixed coil disposed opposite the movable portion, thereby enabling intensification and swift establishment of magnetic fields generated between the coils.

19 Claims, 22 Drawing Sheets

OPEN STATE

CLOSED STATE

OPEN STATE

CLOSED STATE

OPEN STATE

CLOSED STATE

OPEN STATE

CLOSED STATE

FIG. 18

| S% | 0 | 13 | 20 | 40 |
|---|---|---|---|---|
| T | 1 | 0.85 | 0.80 | 0.92 |

WHERE T IS 1 WHEN THERE ARE NO SLITS.

FIG. 19

| L | 0 | 1/4 | 2/4 | 3/4 |
|---|---|---|---|---|
| F | 100 | 100 | 96 | 85 |

WHERE F IS 100% WHEN THERE ARE NO SLITS.

OPEN STATE

CLOSED STATE

SWITCHING ASSEMBLY

BACKGROUND OF THE INVENTION

1. Field of the Invention

The present invention relates to a switching assembly for performing an electrode switching operation by means of electromagnetic actuation.

2. Description of the Related Art

FIG. 24 is a general block diagram of a switching assembly which is a first conventional example employing electromagnetic repulsion such as that disclosed in "Shingata Kousoku Suitchi no Kaihei Dousa Tokusei (Switching Operation Characteristics of New High-Speed Switches)", Heisei 8-Nen Denki Gakkai Sangyou Ouyou Bumon Zenkoku Taikai Kouen Bangou 260 (Lecture No. 260, 1996 Institute of Electrical Engineers Industrial Applications Division All-Japan Conference), for example. FIG. 24A shows the closed state, and FIG. 24B shows the open state.

This switching assembly includes:

- a switch portion 1 including a contactable fixed electrode 6 and a movable electrode 5;
- a repulsion plate 2 secured to a central portion of a movable shaft 4 connected to the movable electrode 5;
- an opening coil 3*a* for inducing current in the repulsion plate 2, the opening coil 3*a* being disposed on the same side of the repulsion plate 2 as the movable electrode 5 in an axial direction; and
- a closing coil 3*b* for inducing current in the repulsion plate, the closing coil 3*b* being disposed on the opposite side of the repulsion plate 2 from the opening coil 3*a*. The opening coil 3*a* and the closing coil 3*b* are connected to a magnetic field-generating current source (not shown).

Terminals 7 connecting to a circuit are connected to the movable electrode 5 and the fixed electrode 6. Contact pressure input springs 8*a* and 8*b* for providing contact pressure between the movable electrode 5 and the fixed electrode 6 when the electrodes are closed, and an auxiliary circuit 9 working together with the opening and closing of the switch portion 1, are disposed at the opposite end of the movable shaft 4 from the movable electrode 5.

FIG. 25 is a graph showing the load characteristics of the contact pressure input springs 8*a* and 8*b* and their combined loads. In the graph, 40 are the load characteristics of the contact pressure input spring 8*a*, 41 are the load characteristics of the contact pressure input spring 8*b*, and 42 are the combined loads of the contact pressure input springs 8*a* and 8*b*. The contact pressure input springs 8*a* and 8*b* are each disposed such that a load arises in a closing direction when the combined load is in a region of deflection from the central position to the closed position, and a load is provided in an opening direction when the combined load is in a region of deflection from the central position to the open position.

Next, the opening operation of a switching device of the above construction will be explained.

In the closed state shown in FIG. 24A, a magnetic field is generated when a pulsed current is passed through the opening coil 3*a*. A current is thus induced in the repulsion plate 2 such that a magnetic field is generated in a direction which cancels the magnetic field generated by the opening coil 3*a*. By interaction between the magnetic field generated by the opening coil 3*a* and the magnetic field generated by the repulsion plate 2, the repulsion plate 2 is subjected to electromagnetic repulsion relative to the coil 3*a*. The movable shaft 4 and the movable electrode 5, which are secured to the repulsion plate, are moved in the direction of repulsion by this electromagnetic repulsion. Then, as shown in FIG. 25, as the amount of deflection of the contact pressure input springs 8*a* and 8*b* changes from the closed position to the central position, the load characteristics 42 decrease, and when the central position is exceeded, the load characteristics become load in the opening direction, and when the amount of deflection of the contact pressure input springs 8*a* and 8*b* reaches the open position, the switch 1 is held in the open state shown in FIG. 24B.

Next, the closing operation of the switching device will be explained.

In the open state shown in FIG. 24B, a magnetic field is generated when a pulsed current is passed through the closing coil 3*b*. A current is thus induced in the repulsion plate 2, and the repulsion plate 2 is subjected to electromagnetic repulsion relative to the closing coil 3*b*. The movable shaft 4 and the movable electrode 5, which are secured to the repulsion plate, are moved in the direction of repulsion by this electromagnetic repulsion. Then, as shown in FIG. 25, as the amount of deflection of the contact pressure input springs 8*a* and 8*b* changes from the open position to the central position, the load characteristics 42 increase, and when the central position is exceeded, the load characteristics become load in the closing direction, and when the amount of deflection of the contact pressure input springs 8*a* and 8*b* reaches the closed position, the switch 1 is in the closed state shown in FIG. 24A.

FIG. 26 shows the slit construction of a plunger-type electromagnet which is part of a switching device which is a second conventional example such as that disclosed in Japanese Utility Model No. SHO 58-103114, for example.

In the drawing, a movable body 101 composed of magnetic material is secured to a tip portion of a movable shaft 100. A blade spring 106 is secured to one side of the movable body 101. A fixed body 102 composed of magnetic material opposes the movable body 101 across an air gap portion 104. A coil 103 surrounded by an iron core 105 is disposed around a circumference of the fixed body 102.

FIG. 27 is a perspective of the fixed body 102 in FIG. 26, and FIG. 28 shows cross-sections of structural elements of the fixed body 102.

The fixed body 102 includes a first cylinder portion 107, a second cylinder portion 108, and a third cylinder portion 109 each formed with a slit 110 and laminated.

Next, the operation of a switching assembly of the above construction will be explained.

A magnetic field is generated when an electric current is passed through the coil 103, and this magnetic field forms a closed magnetic pathway crossing to the movable body 101 via the fixed body 102 and the air gap portion 104 and then returning to the fixed body 102 via the iron core 105. At that time, magnetic attraction arises between the movable body 101 and the fixed body 102 due to interaction between the magnetic fields generated in each. The movable shaft 100 integrated with the movable body 101 is moved in opposition to the elastic force of the blade spring 106 by this magnetic attraction. Thus, a movable electrode (not shown) connected to a tip portion of the movable shaft 100 is separated from a fixed electrode (not shown), for example, opening the contacts of the switching assembly.

When the electric current in the coil 103 is interrupted, the fixed body 102 is demagnetized and the movable shaft 100 integrated with the movable body 101 is returned to its original position by the elastic force of the blade spring 106, closing the contacts of the switching assembly.

In this switching assembly, when the magnetic field is generated, induced currents which generate electric fields in directions which obstruct the magnetic pathway arise in the movable body 101, the fixed body 102, and the iron core 105. Eddy currents which arise in the movable body 101 and the fixed body 102, in particular, obstruct swift generation of the above electromagnetic attraction, resulting in delays in the movement of the movable shaft 100. In this example, swift establishment of electromagnetic force is ensured by using a laminated construction in the fixed body 102 comprising first to third cylinder portions 107, 108, and 109 and forming slits 110 therein in order to suppress eddy currents.

In the switching assembly of the first conventional example, because the magnetic field arising in the repulsion plate 2 due to induced current is small compared to the magnetic field generated by the direct supply of electric current from the electrical circuit, the electromagnetic repulsion due to interaction between the magnetic field generated in the coil and the magnetic fields generated by induction is small, making a high energy level necessary for the closing and opening operations, and one problem has been the enlargement of the opening coil 3*a* and the closing coil 3*b* and of the power source supplying pulsed current to the opening coil 3*a* and the closing coil 3*b*.

In the switching assembly of the second conventional example, the fixed body 102 has a laminated construction formed with slits 110, and one problem has been that the construction is complicated and preparation is difficult, raising costs. Furthermore, eddy currents are not induced in the fixed body 102 when electric current is passed through the coil 103 and the magnetic field is generated, but induced currents generating magnetic fields in directions which cancel the magnetic field generated in the coil arise in the movable body 101. Thus, because the magnetic field generated in the air gap portion 104 is small compared to the magnetic fields generated by the direct supply of electric current to the fixed body and the movable body, respectively, magnetic attraction between the movable body 101 and the fixed body 102 due to interaction with the generated magnetic field is small, delaying the operating speed, and another problem has been that it has been necessary to enlarge the coil and to enlarge the power source supplying pulsed electric current to the coil when attempting to increase the operating speed, making it necessary to increase the overall size of the assembly.

SUMMARY OF THE INVENTION

The present invention aims to solve the above problems and an object of the present invention is to provide a switching assembly enabling the energy required for the opening and closing operations to be reduced, and enabling the overall size of the assembly to be reduced by reducing the size of the driving power source.

To this end, according to the present invention, there is provided a switching assembly comprising: a switch portion comprising a fixed electrode and a movable electrode which are separable; a movable shaft moving together with the movable electrode; a movable portion having a magnetic body secured to the movable shaft and a movable coil surrounding an outer side of the magnetic body; and a fixed portion having a magnetic body slidably disposed on the movable shaft and a fixed coil surrounding an outer side of the magnetic body, the fixed portion being disposed opposite the movable portion, the fixed electrode and the movable electrode being separable by moving the movable portion and the movable shaft by electromagnetic force acting between the movable coil and the fixed coil, the electromagnetic force being generated by passage of excitation current through the movable coil and the fixed coil.

According to another aspect of the present invention, there is a switching assembly comprising: a switch portion comprising a fixed electrode and a movable electrode which are separable; a movable shaft moving together with the movable electrode; a movable portion having a movable coil and a magnetic body covering the movable coil, the movable portion being secured to the movable shaft; and a fixed portion having a fixed coil and a magnetic body covering the fixed coil, the fixed portion being disposed opposite the movable portion, the fixed electrode and the movable electrode being separable by moving the movable portion and the movable shaft by electromagnetic force acting between the movable coil and the fixed coil, the electromagnetic force being generated by passage of excitation current through the movable coil and the fixed coil.

According to still another aspect of the present invention, there is a switching assembly comprising: a switch portion comprising a fixed electrode and a movable electrode which are separable; a movable shaft moving together with the movable electrode; a movable portion comprising a dielectric body secured to the movable shaft; and a first fixed portion and a second fixed portion each having a magnetic body and a fixed coil, the first fixed portion and the second fixed portion being disposed opposite the movable portion on both sides of the movable portion in an axial direction, the fixed electrode and the movable electrode being separable by moving the movable portion and the movable shaft by electromagnetic force acting between the movable portion and the first fixed portion and between the movable portion and the second fixed portion, the electromagnetic force being generated by passage of excitation current through the fixed coil of the first fixed portion and the fixed coil of said second fixed portion.

According to another aspect of the present invention, a switching assembly comprising: a switch portion comprising a fixed electrode and a movable electrode which are separable; a movable shaft moving together with the movable electrode; a movable body secured to the movable shaft; a fixed body disposed opposite the movable body, the fixed body being slidable relative to the movable shaft; and a coil for contacting and separating the fixed body and the movable body by means of electromagnetic force generated by passage of electric current, slits for suppressing eddy currents being formed in at least one opposing surface of the movable body or the fixed body.

BRIEF DESCRIPTION OF THE DRAWINGS

FIG. 18 is a table showing the relationship between the ratio of space occupied by slits in opposing surfaces of a movable body and a fixed body, and contact opening time;

FIG. 19 is a table showing the relationship between the length of slits in circumferential surfaces of a movable body and a fixed body, and magnetic attraction between the movable body and the fixed body;

DETAILED DESCRIPTION OF THE PREFERRED EMBODIMENTS

The present invention will be explained below with reference to illustrative preferred embodiments. In the explanation, parts which are the same as or correspond to those of the conventional examples will be given the same numbering.

Embodiment 1

Figure 1B:
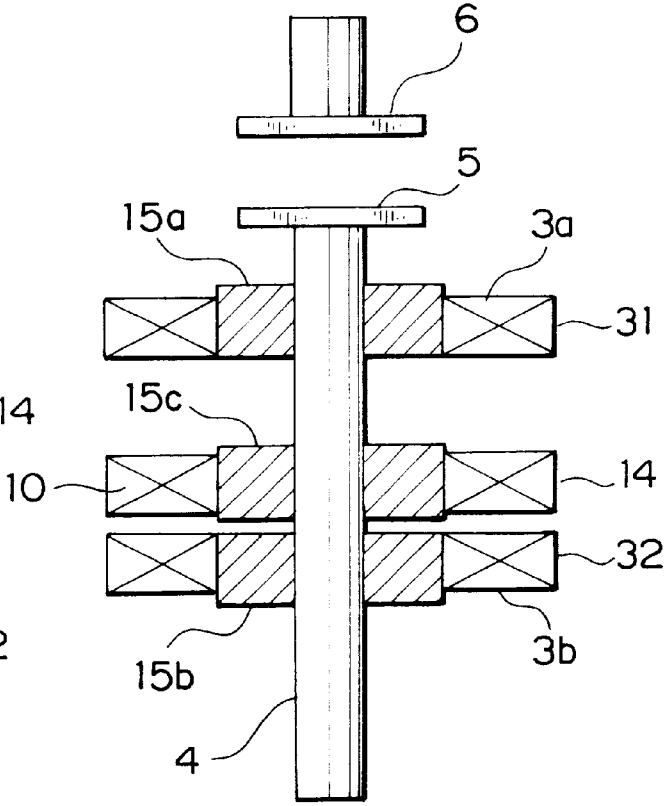
FIGS. 1A and 1B are partial structural diagrams of a switching assembly according to Embodiment 1 of the present invention, 1A showing a closed state and 1B showing an open state.
Figure 1A:
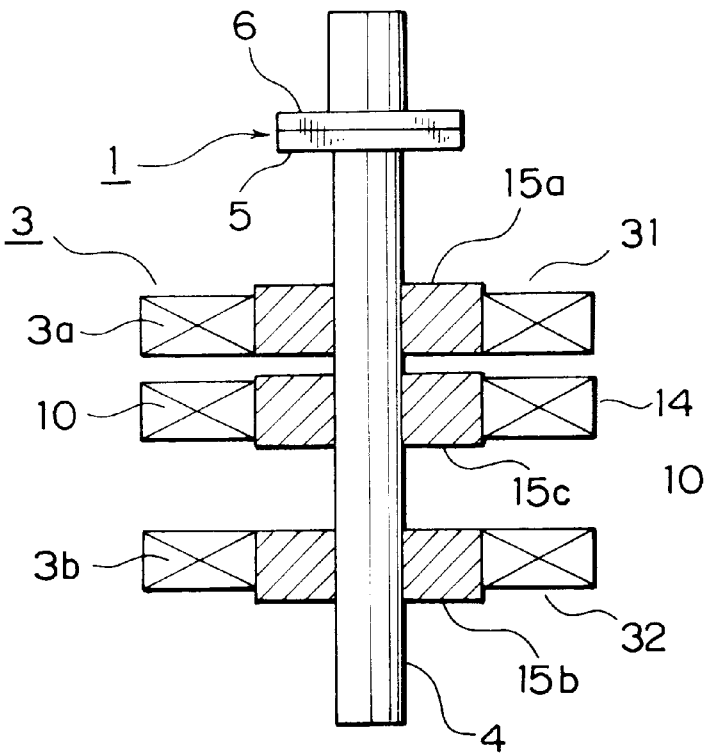

FIGS. 1A and 1B are structural diagrams of an electromagnetic repulsion mechanism which is part of a switching assembly according to Embodiment 1 of the present invention, FIG. 1A showing a closed state of the assembly and FIG. 1B showing an open state of the assembly.

This switching assembly includes:

a switch portion 1 including a contactable fixed electrode 6 and a movable electrode 5;

a movable portion 14 having a movable coil 10 secured by means of a magnetic body 15*c* to a central portion of a movable shaft 4 connected to the movable electrode 5; and a fixed portion 3 slidably disposed on the movable shaft 4.

The fixed portion 3 includes a first fixed portion 31 and a second fixed portion 32 positioned on opposite sides of the movable portion 14 from each other. The first fixed portion 31, which is on the same side of the movable portion 14 as the movable electrode 5, has a magnetic body 15*a* opposite the magnetic body 15*c*, and an opening coil 3*a* opposite the movable coil 10. The second fixed portion 32, which is on the opposite side of the movable portion 14 from the movable electrode 5, has a magnetic body 15*b* opposite the magnetic body 15*c*, and a closing coil 3*b* opposite the movable coil 10.

The magnetic bodies 15*c*, 15*a*, and 15*b* of the movable portion 14, the first fixed portion 31, and the second fixed portion 32, respectively, are disposed radially inside the movable coil 10, the opening coil 3*a*, and the closing coil 3*b*, respectively. Bores enabling the through-passage of the movable shaft 4 are formed in the magnetic bodies 15*c*, 15*a*, and 15*b*. The movable shaft 4 is secured to the inner surface of the bore of the magnetic body 15*c* of the movable portion 14, relative motion between the movable portion 14 and the movable shaft 4 is prevented, and the movable shaft 14 is slidably disposed in the bore of the magnetic body 15*a* of the first fixed portion 31 and the bore of the magnetic body 15*b* of the second fixed portion 32.

Figure 2B:
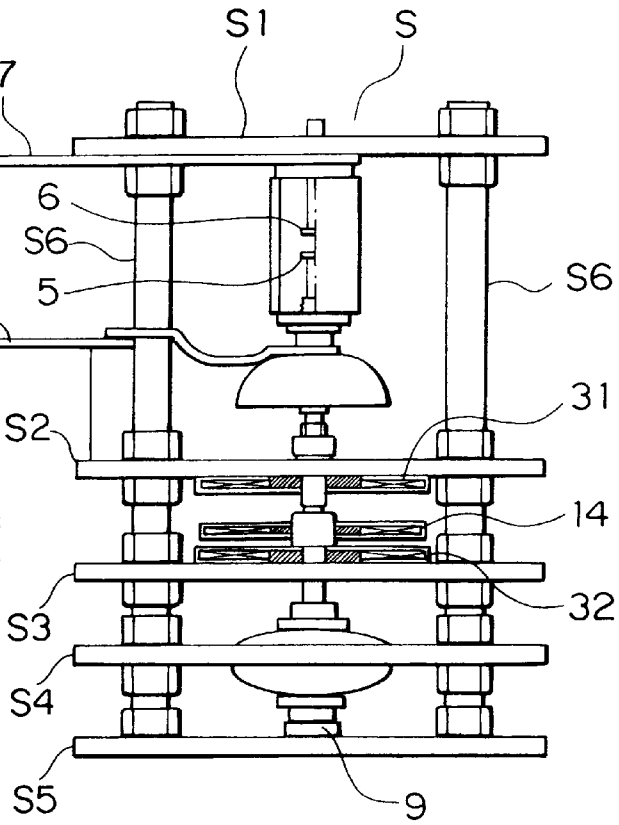
FIGS. 2A and 2B are complete structural diagrams of a switching assembly according to Embodiment 1 of the present invention, 2A showing the closed state and 2B showing the open state.
Figure 2A:
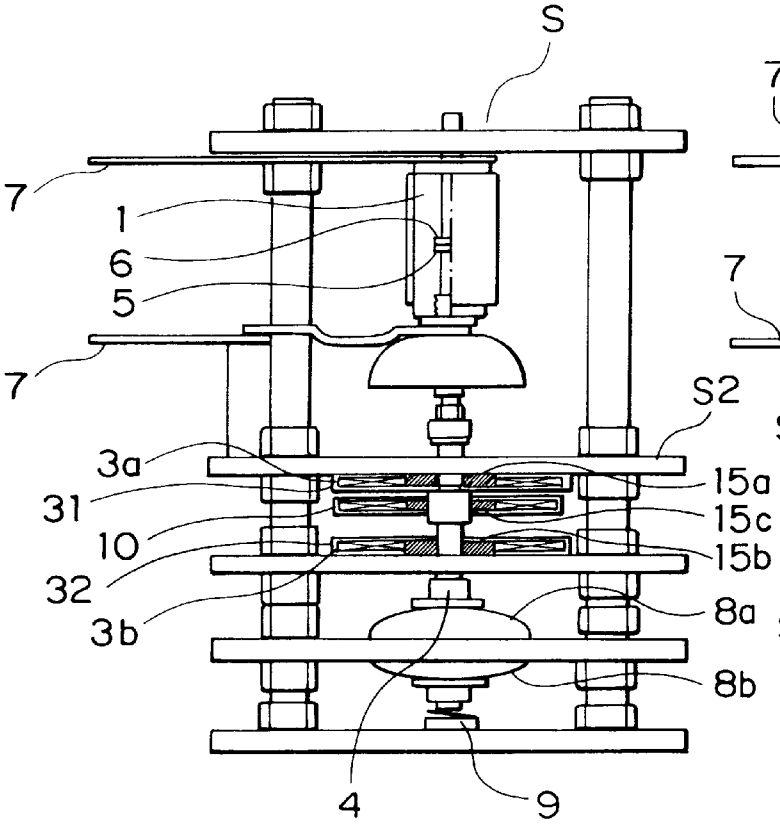

FIGS. 2A and 2B are complete structural diagrams of a switching assembly according to the present invention with the electromagnetic repulsion mechanism of FIGS. 1A and 1B installed therein, FIG. 2A showing the closed state of the assembly and FIG. 2B showing the open state of the assembly.

Terminals 7 for connecting the movable electrode 5 and the fixed electrode 6 of the switch portion 1 of the switching assembly to a circuit are connected to the movable electrode 5 and the fixed electrode 6, respectively. Contact pressure input springs 8*a* and 8*b* for providing contact pressure between the movable electrode 5 and the fixed electrode 6 when the electrodes are closed, and an auxiliary circuit 9 working together with the opening and closing of the switch portion 1, are disposed at the opposite end of the movable shaft 4 from the movable electrode 5. The construction and function of the contact pressure input springs 8*a* and 8*b* is identical to that of the first conventional example and explanation thereof will be omitted.

The switch portion 1, the movable portion 14, the first fixed portion 31, the second fixed portion 32, the contact pressure input springs 8*a* and 8*b*, etc., are installed in a supporting frame S. The supporting frame S includes: a switch portion support member S1 for supporting and securing the switch portion 1; a first fixed portion support member S2 for supporting and securing the first fixed portion 31; a second fixed portion support member S3 for supporting and securing the second fixed portion 32; a spring support member S4 for supporting and securing the contact pressure input springs 8*a* and 8*b;* an auxiliary switch support member S5 for supporting and securing the auxiliary switch 9; and a number of securing rods S6 joining each of the support members S1 to S5.

Figure 3:
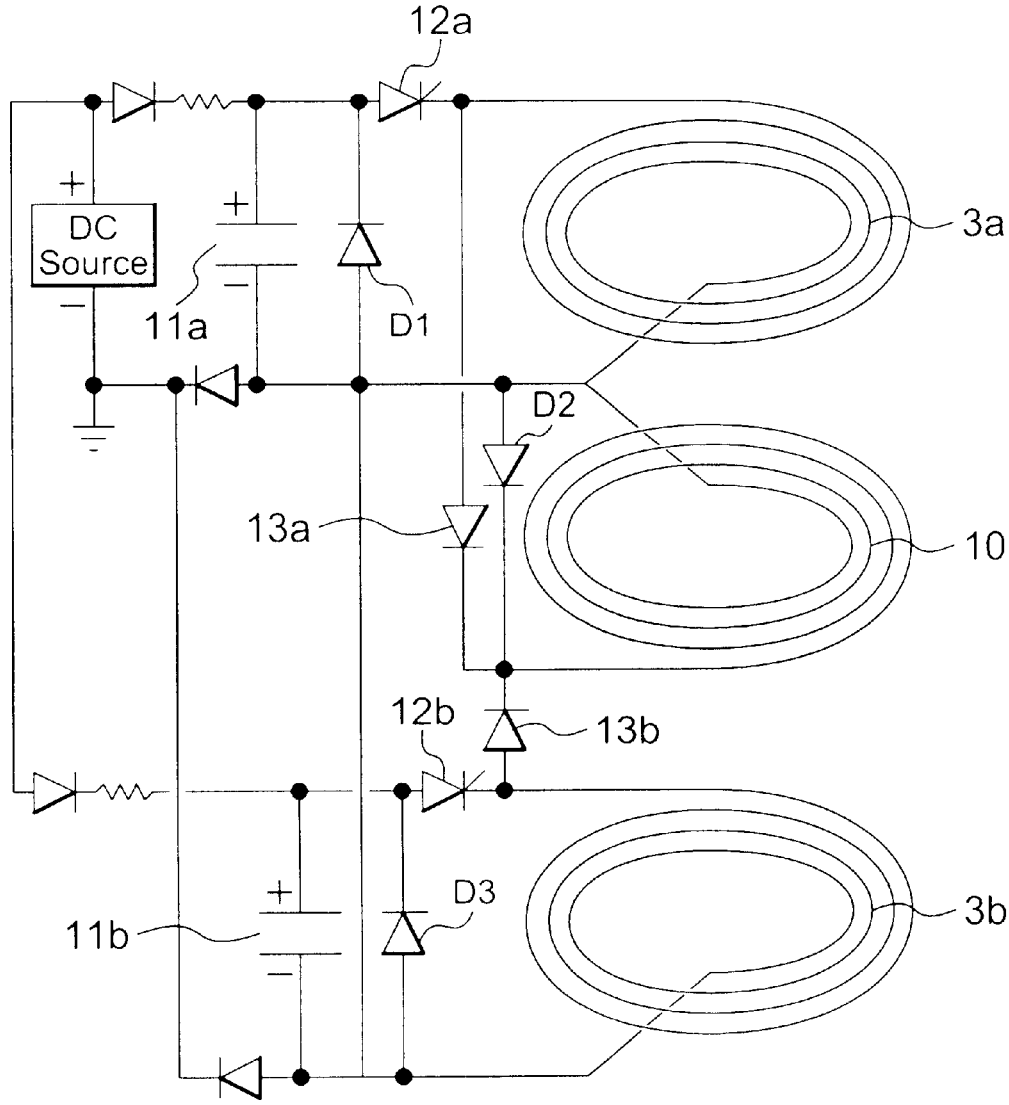
FIG. 3 is a diagram showing an example of connection of the opening coil, the closing coil, and the movable coil in FIG. 1 to a power source supplying pulsed electric current thereto which may be used in a switching assembly according to Embodiment 1 of the present invention.

FIG. 3 is a connecting circuit diagram showing the opening coil 3*a,* the closing coil 3*b,* and the movable coil 10 in FIG. 1 electrically connected to a power source supplying pulsed electric current thereto.

This connecting circuit includes an opening power reservoir 11*a* and a closing power reservoir 11*b* together constituting a power source supplying an excitation current (pulsed current) to the opening coil 3*a* and the closing coil 3*b,* and a current direction setting means for setting the direction of the excitation current from the opening power reservoir 11*a* and the closing power reservoir 11*b* to each of the coils 10, 3*a,* and 3*b* such that interaction of magnetic fields occurs between the movable coil 10 and the opening coil 3*a* or between the movable coil 10 and the closing coil 3*b* during opening and closing of the switch portion 1. The current direction setting means includes an opening discharge switch 12*a,* a closing discharge switch 12*b,* and coil-connecting diodes 13*a* and 13*b.*

The opening coil 3*a* and the movable coil 10 are connected in parallel by means of the coil-connecting diode 13*a* so that pulsed current is supplied from the opening power reservoir 11*a* via the opening discharge switch 12*a* to the opening coil 3*a* and the movable coil 10. The closing coil 3*b* and the movable coil 10 are similarly connected in parallel by means of the coil-connecting diode 13*b* so that pulsed current is supplied from the closing power reservoir 11*b* via the closing discharge switch 12*b* to the closing coil 3*a* and the movable coil 10. The coil-connecting diode 13*a* is inserted between the opening discharge switch 12*a* and the movable coil 10. The coil-connecting diode 13*b* is inserted between the closing discharge switch 12*b* and the movable coil 10. In this embodiment, the opening power reservoir 11*a* and the closing power reservoir 11*b* are capacitors, but they may also be storage cells.

Moreover, D1 is a diode connected in parallel to the opening coil 3*a* for discharging electromagnetic energy which has built up in the opening coil 3*a,* D2 is a diode connected in parallel to the movable coil 10 for discharging electromagnetic energy which has built up in the movable coil 10, and D3 is a diode connected in parallel to the closing coil 3*b* for discharging electromagnetic energy which has built up in the closing coil 3*b.*

In this embodiment, the direction of the excitation current during opening of the switch portion 1 is set such that magnetic repulsion arises between the movable coil 10 and the opening coil 3*a* when the excitation current flows from the opening power reservoir 11*a* to the movable coil 10 and the opening coil 3*a,* which is a fixed coil. The direction of the excitation current during closing of the switch portion 1 is set such that magnetic repulsion arises between the movable coil 10 and the closing coil 3*b* when the excitation current flows from the closing power reservoir 11*b* to the movable coil 10 and the closing coil 3*b,* which is a fixed coil.

Next, the contact opening operation of a switching device of the above construction will be explained.

When the opening discharge switch 12*a* in FIG. 3 is switched on, pulsed current flows from the opening power reservoir 11*a* through the opening discharge switch 12*a* to the opening coil 3*a,* generating a magnetic field. The magnetic flux density of the generated magnetic field is intensified by the magnetic effects of the magnetic body 15*a* of the first fixed portion 31, increasing the strength of the magnetic field generated in the surrounding space. Pulsed current flows simultaneously through the movable coil 10, generating a magnetic field opposite in direction to the magnetic field generated in the opening coil 3*a.* The magnetic flux density of this generated magnetic field is similarly intensified by the magnetic effects of the magnetic body 15*c* of the movable portion 14, increasing the strength of the magnetic field generated in the surrounding space. Consequently, mutually opposing magnetic fields are generated in the opening coil 3*a* and the movable coil 10, and the movable coil 10 is subjected to electromagnetic repulsion down the page in FIG. 3 by the interaction of these magnetic fields. As a result, the movable portion 4 and the movable shaft 4 fastened to the movable portion 14 are pushed downwards and the movable electrode 5 of the switch portion 1 is separated from the fixed electrode 6, opening the switch portion 1.

Now, after the pulsed current is interrupted, electromagnetic energy which has built up in the opening coil 3*a* passes through the diode D1 and the opening discharge switch 12*a,* circulates back to the opening coil 3*a* and gradually attenuates. Electromagnetic energy which has built up in the movable coil 10 passes through the diode D2, circulates back to the movable coil 10 and gradually attenuates. Here, because the pulsed current is prevented from flowing into the closing coil 3*b* by the coil-connecting diode 13*b* inserted between the movable coil 10 and the closing coil 3*b,* interaction between the closing coil 3*b* and the movable coil 10 due to such a flow does not occur, and the opening operation is performed reliably. Furthermore, because the coil-connecting diode 13*a* prevents current from flowing from the closing power reservoir 11*b* to the opening power reservoir 11*a* after the opening power reservoir 11*a* has discharged the pulsed current, the closing operation can be performed immediately after the opening operation.

Next, the contact closing operation of a switching device of the above construction will be explained.

When the closing discharge switch 12*b* in FIG. 3 is switched on, pulsed current flows from the closing power reservoir 11*b* through the discharge switch 12*b* to the closing coil 3*b,* generating a magnetic field. The magnetic flux density of the generated magnetic field is intensified by the magnetic effects of the magnetic body 15*b* of the second fixed portion 32, increasing the strength of the magnetic field generated in the surrounding space. Pulsed current flows simultaneously through the movable coil 10, generating a magnetic field opposite in direction to the magnetic field generated in the closing coil 3*b.* The magnetic flux density of this generated magnetic field is similarly intensified by the magnetic effects of the magnetic body 15*c,* increasing the strength of the magnetic field generated in the surrounding space. Consequently, mutually opposing magnetic fields are generated in the closing coil 3*b* and the movable coil 10, and the movable coil 10 is subjected to electromagnetic repulsion up the page in FIG. 3 by the interaction of these magnetic fields. As a result, the movable portion 4 and the movable shaft 4 fastened to the movable portion 14 are pushed upwards and the movable electrode 5 and the fixed electrode 6 of the switch portion 1 contact, closing the switch portion 1.

Now, after the pulsed current is interrupted, electromagnetic energy which has built up in the closing coil 3*b* passes through the diode D3 and the closing discharge switch 12*b,* circulates back to the closing coil 3*b* and gradually attenuates. Electromagnetic energy which has built up in the movable coil 10 passes through the diode D2, circulates back to the movable coil 10 and gradually attenuates.

Furthermore, because the coil-connecting diode 13*b* prevents current from flowing from the opening power reservoir 11*a* to the closing power reservoir 11*b* after the closing power reservoir 11*b* has discharged the pulsed current, the opening operation can be performed reliably after performing the closing operation.

Figure 4:
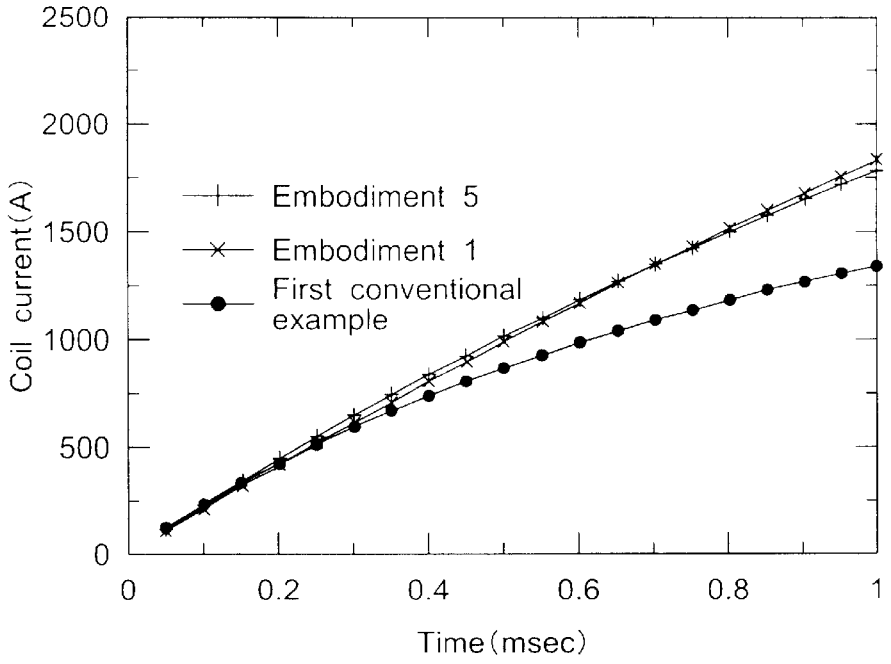
FIG. 4 is a graph showing change in electric current over time from results of analyses of effects according to Embodiment 1 of the present invention.
Figure 5:
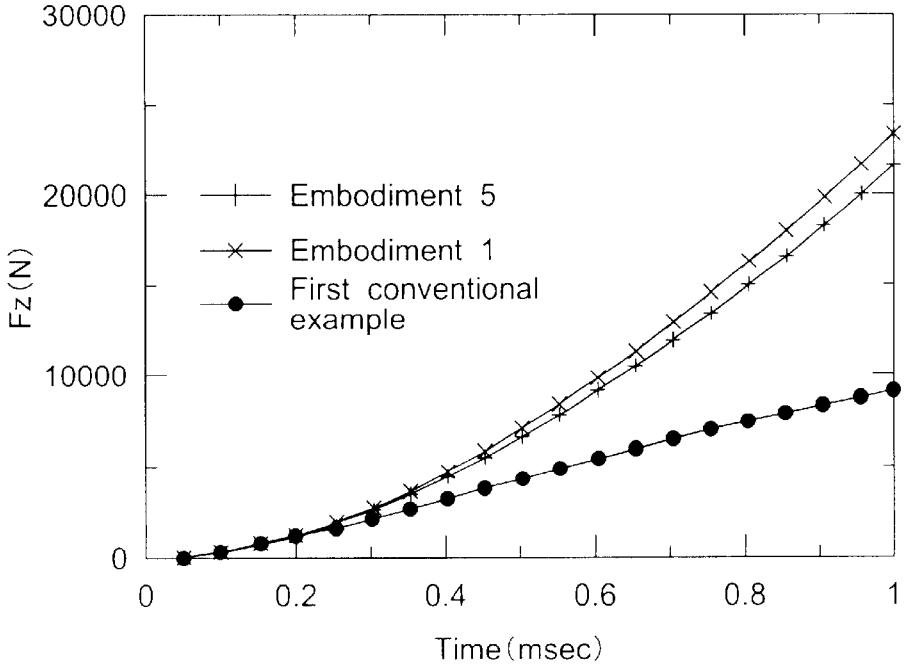
FIG. 5 is a graph showing change in electromagnetic force over time from results of analyses of effects according to Embodiment 1 of the present invention.

FIG. 4 is a graph obtained by analysis of transient response electromagnetic fields showing the relationship between time response and the coil current flowing through each of the coils 3*a,* 3*b,* and 10 when a voltage of constant value is impulse excited through each of the coils 3*a,* 3*b,* and 10, and FIG. 5 is a graph obtained by analysis of transient response electromagnetic fields showing the relationship between time response and electromagnetic repulsion (Fz) arising in the movable portion 14 when a voltage of constant value is impulse excited through each of the coils 3*a,* 3*b,* and 10.

Comparing Embodiment 1 to the first conventional example in FIGS. 4 and 5, it can be seen that the magnetic flux density is intensified relative to change in current over time by the magnetic effects of the magnetic bodies 15*a,* 15*b,* and 15*c,* and the increase in electromotive force in Embodiment 1 is extremely large. In particular, because the magnetic bodies 15*a,* 15*b,* and 15*c* are disposed only radially inside each of the annular coils 3*a,* 3*b,* and 10, amplification of the field strength can be achieved by a small amount of magnetic energy without hindering the speed at which the current increases, thereby enabling the switch portion 1 to operate swiftly.

Next, other embodiments of the present invention will be explained. In the following explanations, in general only points differing from Embodiment 1 will be explained and the rest of the construction and operation will be omitted in each case.

Embodiment 2

Figure 6B:
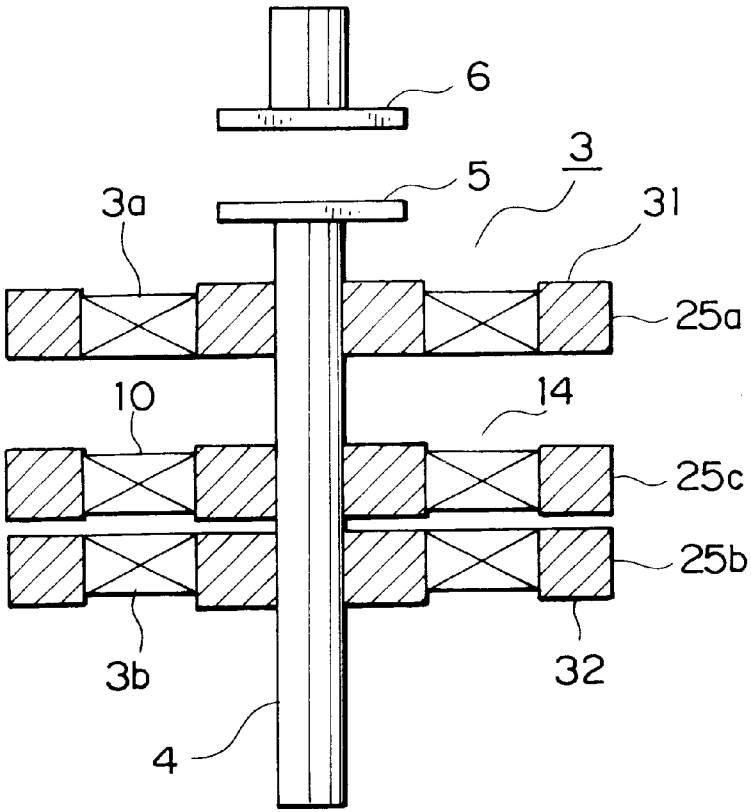
FIGS. 6A and 6B are partial structural diagrams of a switching assembly according to Embodiment 2 of the present invention, 6A showing a closed state and 6B showing an open state.
Figure 6A:
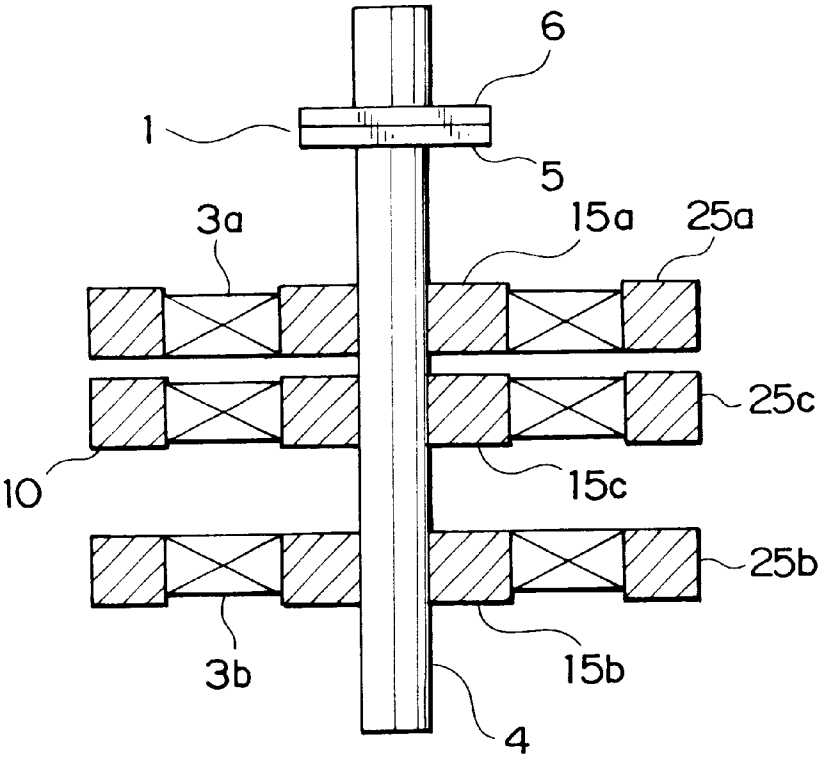

FIGS. 6A and 6B are structural diagrams of an electromagnetic repulsion mechanism which is part of a switching assembly according to Embodiment 2 of the present invention, FIG. 6A showing a closed state of the switching assembly and FIG. 6B showing an open state of the switching assembly.

In Embodiment 2, ring-shaped external magnetic bodies 25*c,* 25*a,* and 25*b* are disposed on the outside of the movable coil 10, the opening coil 3*a,* and the closing coil 3*b,* respectively, of Embodiment 1.

In Embodiment 2, because the magnetic bodies 15*c,* 15*a,* and 15*b* and the external magnetic bodies 25*c,* 25*a,* and 25*b* are disposed so as to surround the radial inside and radial outside of the movable coil 10, the opening coil 3*a,* and the closing coil 3*b,* magnetic flux density in the space portion is further intensified by magnetic effects compared to Embodiment 1, increasing the magnetic field strength and increasing electromagnetic repulsion with a small current. Furthermore, because the external magnetic bodies 25*c,* 25*a,* and 25*b* also function as a mechanism for maintaining expansive tension acting radially outwards on the movable coil 10, the opening coil 3*a,* and the closing coil 3*b,* there is no need to provide special members to support against expansive tension.

Embodiment 3

Figure 7B:
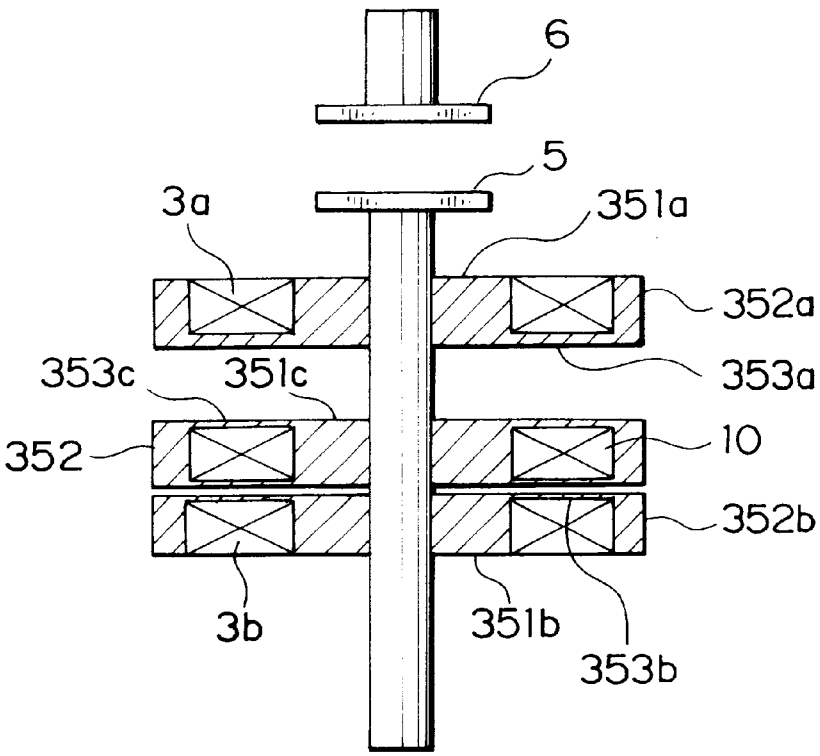
FIGS. 7A and 7B are partial structural diagrams of a switching assembly according to Embodiment 3 of the present invention, 7A showing a closed state and 7B showing an open state.
Figure 7A:
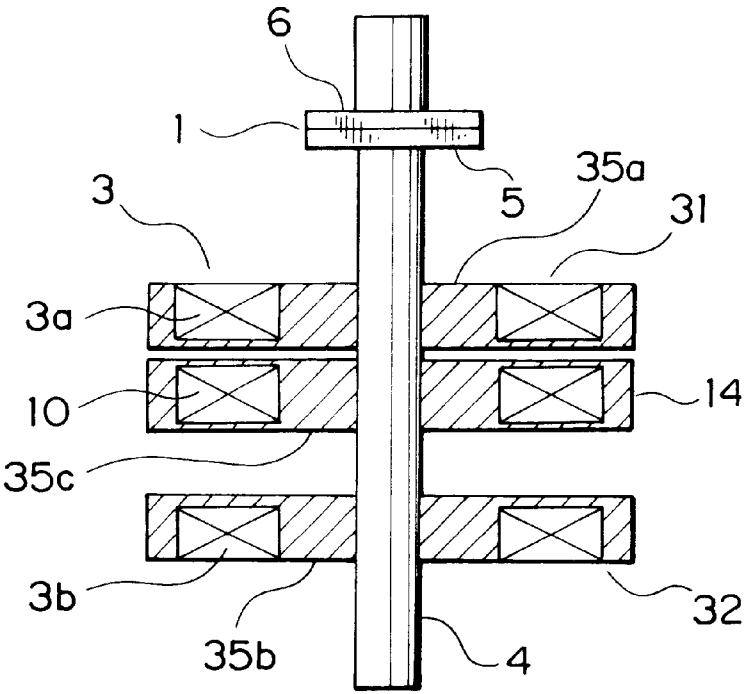

FIGS. 7A and 7B are structural diagrams of an electromagnetic repulsion mechanism which is part of a switching assembly according to Embodiment 3 of the present invention, FIG. 7A showing a closed state of the switching assembly and FIG. 7B showing an open state of the switching assembly.

In Embodiment 3, the magnetic bodies on the inside and outside of the movable coil 10, and the opening and closing coils 3*a* and 3*b* are integrated into magnetic bodies 35*c,* 35*a,* and 35*b* covering the coils 10, 3*a,* and 3*b,* respectively.

The magnetic bodies 35*c,* 35*a,* and 35*b* include radially inner ring portions 351*c,* 351*a,* and 351*b* on the radial inside of the movable coil 10, the opening coil 3*a,* and the closing coil 3*b,* radially outer ring portions 352*c,* 352*a,* and 352*b* on the radial outside, and end surface portions 353*c,* 353*a,* and 353*b* on axially opposing surfaces. In this illustrative example, end surface portions 353*c* are disposed on both axial end surfaces in the case of the movable coil 10, but end surface portions 353*a* and 353*b* are disposed only on the surfaces facing the movable coil 10 in the case of the opening coil 3*a* and the closing coil 3*b*. Naturally, end surface portions 353*a* and 353*b* may also be disposed on both end surfaces of the opening coil 3*a* and the closing coil 3*b* as well.

By forming the magnetic bodies 35*c,* 35*a,* and 35*b* in this manner, magnetic flux density in the space portion is further intensified by magnetic effects, increasing the magnetic field strength in the space portion and enabling the generation of electromagnetic repulsion to be increased with a small current. Furthermore, because the magnetic bodies 35*c,* 35*a,* and 35*b* also act as coil containers for the coils 10, 3*a,* and 3*b,* simplification of the construction is achieved.

Embodiment 4

In Embodiments 1 to 3 above, the movable coil 10, the opening coil 3*a,* and the closing coil 3*b* are each connected in parallel, but the same effects can also be achieved if the movable coil 10, the opening coil 3*a,* and the closing coil 3*b* are connected in series.

In this case, the movable coil 10 and the opening coil 3*a* are connected in series, and pulsed current is supplied from the opening power reservoir 11*a* via the opening discharge switch 12*a*. Similarly, the movable coil 10 and the closing coil 3*b* are connected in series, and pulsed current is supplied from the closing power reservoir 11*b* via the closing discharge switch 12*b*.

Embodiment 5

Figure 8B:
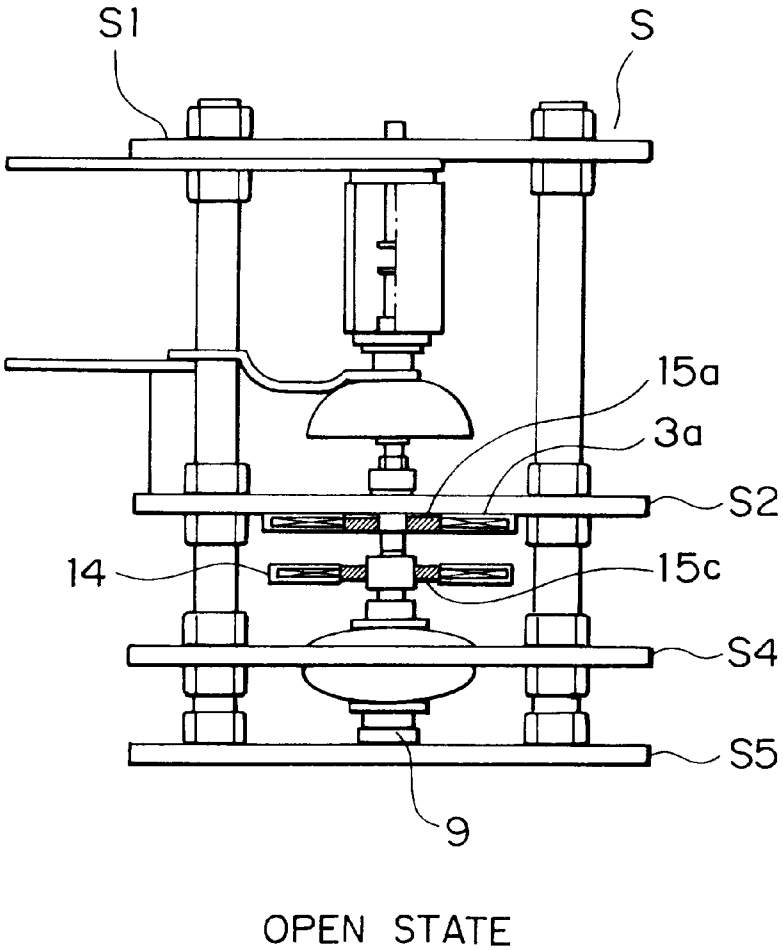
FIGS. 8A and 8B show a switching assembly according to Embodiment 5 of the present invention, 8A showing a closed state and 8B showing an open state.
Figure 8A:
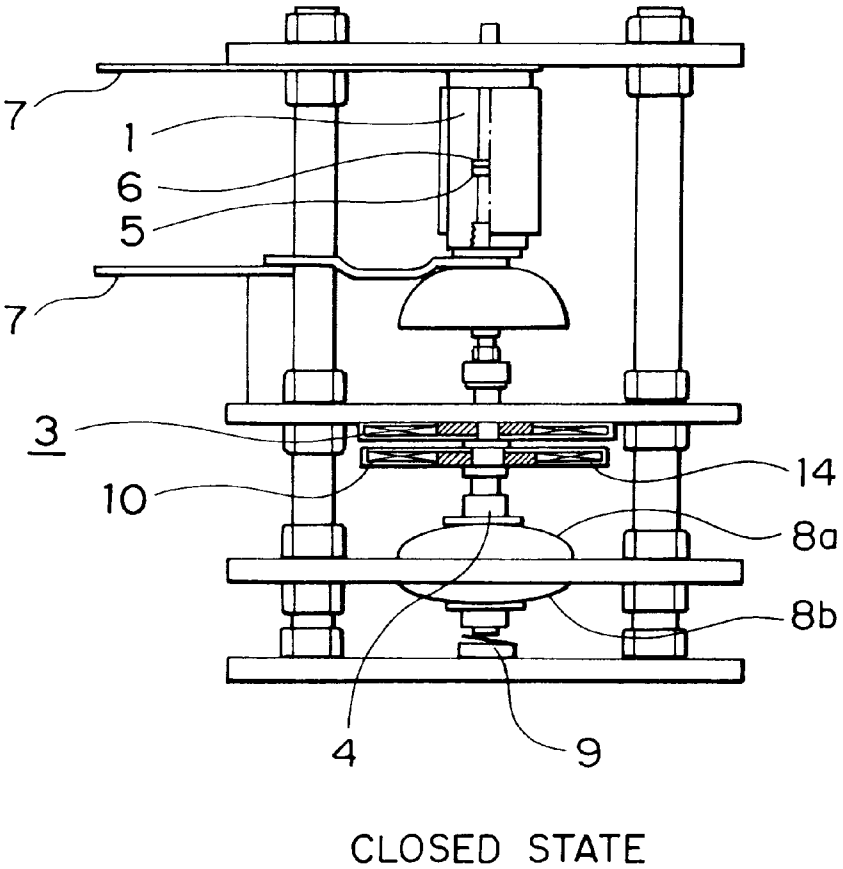

FIGS. 8A and 8B are structural diagrams of a switching assembly according to Embodiment 5 of the present invention, FIG. 8A showing a closed state of the assembly and FIG. 8B showing an open state of the assembly.

In Embodiments 1 to 4 above, the first fixed portion 31 and the second fixed portion 32 provided with the opening coil 3*a* and the closing coil 3*b,* respectively, were disposed above and below the movable portion 14 secured to the movable shaft 4, but in Embodiment 5, a fixed portion 3 composed of the fixed coil 3*a* and the magnetic body 15*a* is disposed only above the movable portion 14.

In the construction of the magnetic bodies 15*c* and 15*a,* external magnetic bodies 25*c* and 25*a* may be disposed as in Embodiment 2, or container-forming magnetic bodies 35*c* and 35*a* may be disposed as in Embodiment 3

Figure 9:
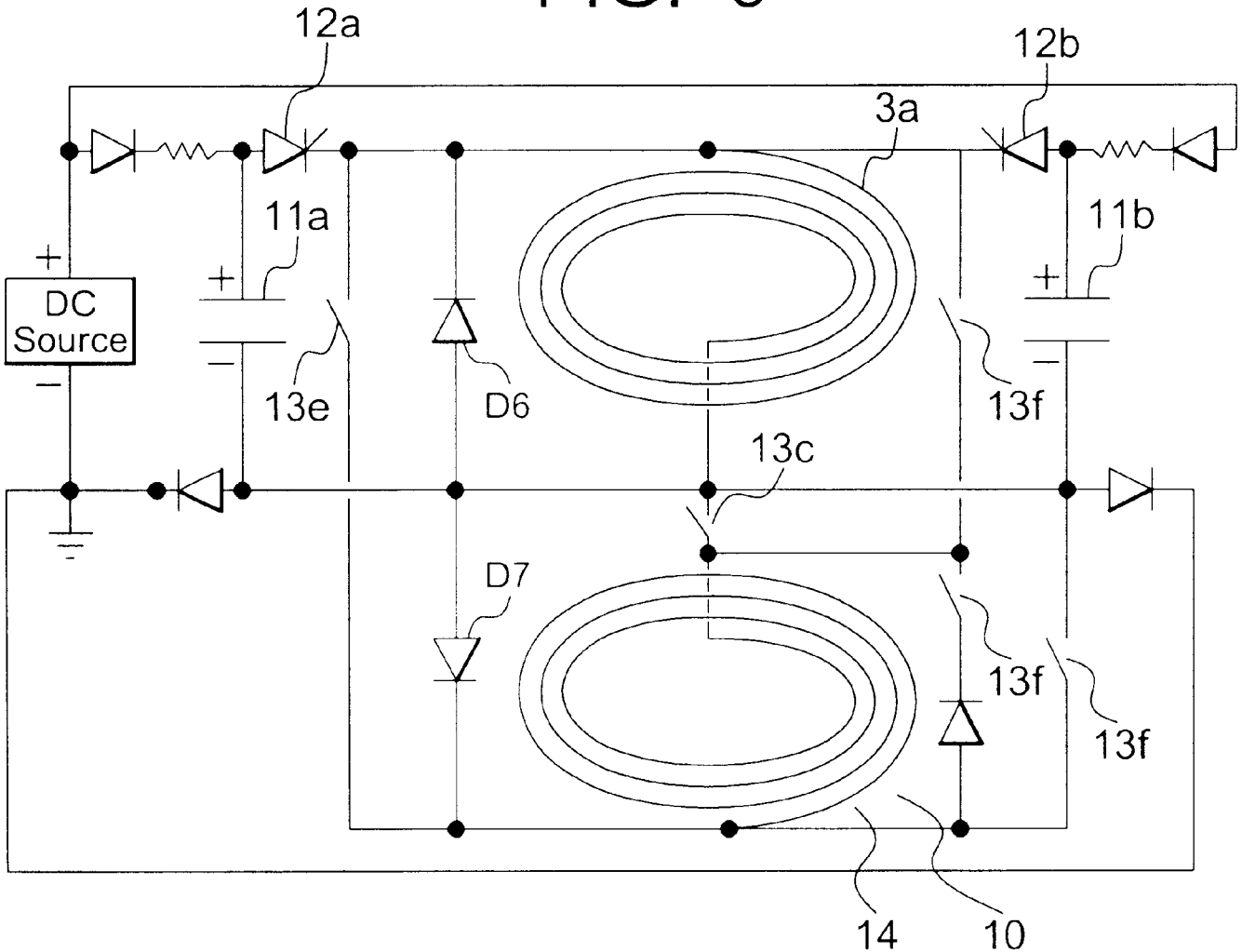
FIG. 9 is a diagram showing an example of connection of the fixed coil and the movable coil in FIG. 8 to a power source supplying pulsed electric current thereto which may be used in a switching assembly according to Embodiment 5 of the present invention.

FIG. 9 is a circuit diagram showing connection of the movable coil 10 and the fixed coil 3*a* in FIG. 8 to a power source supplying pulsed electric current thereto.

In the diagram, 10 is the movable-coil, 14 is the movable portion, 11*a* is the opening power reservoir, 11*b* is the closing power reservoir, 12*a* is the opening discharge switch, 12*b* is the closing discharge switch, 13*c* is a coil-connecting switch, and 13*e* and 13*f* are change-over switches.

This connecting circuit includes an opening power reservoir 11*a* and a closing power reservoir 11*b* together constituting a power source supplying an excitation current (pulsed current) to the movable coil 10 and the fixed coil 3*a,* and a current direction setting means for setting the direction of the excitation current from the opening power reservoir 11*a* and the closing power reservoir 11*b* to each of the coils 10 and 3*a* such that interaction of magnetic fields occurs between the movable coil 10 and the fixed coil 3*a* during opening and closing of the switch portion 1. The current direction setting means includes the opening discharge switch 12*a,* the closing discharge switch 12*b,* the coil-connecting switch 13*c,* and the change-over switches 13*e* and 13*f.*

The movable coil 10 and the fixed coil 3*a* are connected in parallel so that pulsed current is supplied from the opening power reservoir 11*a* and the closing power reservoir 11*b* via the opening discharge switch 12*a.* The coil-connecting switch 13*c* is disposed between the negative electrode of the opening power reservoir 11*a* and the movable coil 10 through the opening discharge switch 12*a.*

For the opening operation, the coil-connecting switch 13*c* and the change-over switch 13*e* are switched on, and the change-over switch 13*f* is switched off. For the closing operation, the coil-connecting switch l3*c* and the change-over switch 13*e* are switched off, and the change-over switch 13*f* is switched on. If the coil-connecting switch 13*c* and the change-over switches 13*e* and 13*f* constitute the auxiliary switch 9 itself in FIG. 8, or operate together with the auxiliary switch 9 and an electronic circuit, reliability of the opening and closing operations can be improved in a similar manner to the above embodiments.

In this embodiment, the direction of the current passing from the opening power reservoir 11*a* to the movable coil 10 and the fixed coil 3*a* during opening of the switch portion 1 is set such that magnetic repulsion arises between the movable coil 10 and the fixed coil 3*a* when the excitation current flows from the opening power reservoir 11*a* to each of the coils 10 and 3*a,* the direction of the current passing from the closing power reservoir 11*b* to the movable coil 10 and the fixed coil 3*a* during closing of the switch portion 1 is set such that magnetic attraction arises between the movable coil 10 and the fixed coil 3*a* when the excitation current flows to each of the coils 10 and 3*a.*

Moreover, D6 is a diode connected in parallel to the fixed coil 3*a* for discharging electromagnetic energy which has built up in the fixed coil 3*a,* and D7 is a diode connected in parallel to the movable coil 10 for discharging electromagnetic energy which has built up in the movable coil 10.

Next, the contact opening operation of a switching device according to this embodiment will be explained.

When the opening discharge switch 12*a* in FIG. 9 is switched on, pulsed current flows from the opening power reservoir 11*a* through the coil-connecting switch 13*c* to the fixed coil 3*a* and the movable coil 10, generating magnetic fields in the fixed coil 3*a* and the movable coil 10 in mutually opposite directions. The movable coil 10 is subjected to electromagnetic repulsion down the page in FIG. 9 by interaction between the two magnetic fields. At the same time, the magnetic flux density of the generated magnetic field is intensified in the surrounding space by the magnetic effects of the magnetic bodies 15*c* and 15*a,* increasing the strength of the magnetic field in the surrounding space. When magnetic field strength is intensified, electromagnetic repulsion also increases, improving actuation efficiency with a small current. As a result, the movable shaft 4 fastened to the movable coil 10 and the magnetic body 15*c* is pushed downwards and the movable electrode 5 of the switch portion 1 and the fixed electrode 6 separate, opening the switch portion 1 in FIG. 8.

Next, the contact closing operation of a switching device according to this embodiment will be explained.

When the closing discharge switch 12*b* in FIG. 9 is switched on, pulsed current flows from the closing power reservoir 11*b* through the change-over switch 13*f* to the fixed coil 3*a* and the movable coil 10, generating magnetic fields in the fixed coil 3*a* and the movable coil 10 in mutually similar directions. The movable coil 10 is subjected to electromagnetic attraction up the page in FIG. 9 by interaction between the two magnetic fields. At the same time, the magnetic flux density of the generated magnetic field is intensified in the surrounding space by the magnetic effects of the magnetic bodies 15*c* and 15*a,* increasing the strength of the magnetic field in the surrounding space. When magnetic field strength is intensified, electromagnetic force also increases, improving actuation efficiency with a small current. As a result, the movable shaft 4 fastened to the movable coil 10 and the magnetic body 15*c* is pulled upwards, opening the switch portion 1 in FIG. 8B.

Embodiment 6

Figure 10B:
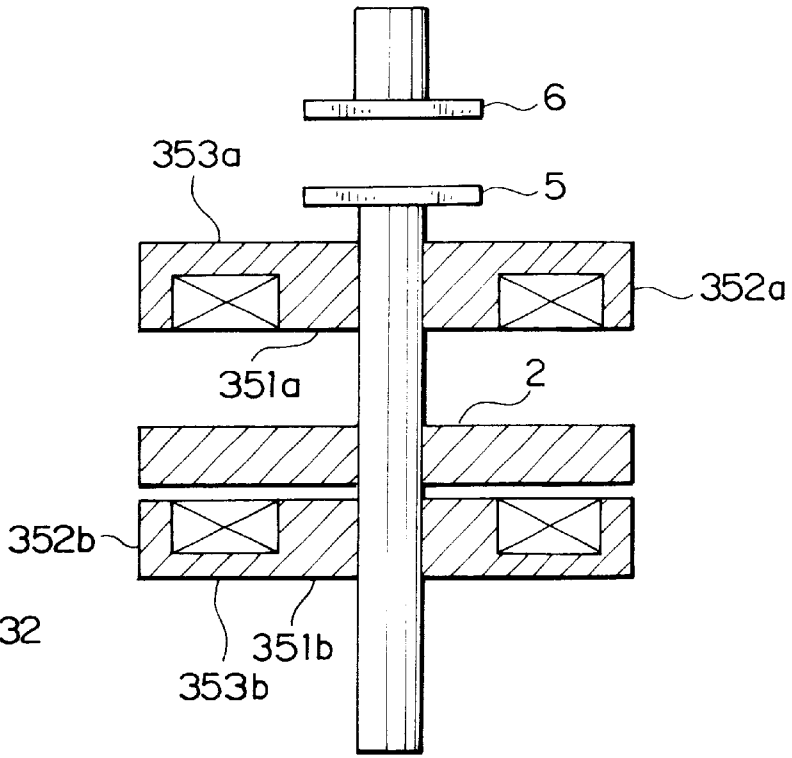
FIGS. 10A and 10B are partial structural diagrams of a switching assembly according to Embodiment 6 of the present invention, 10A showing a closed state and 10B showing an open state.
Figure 10A:
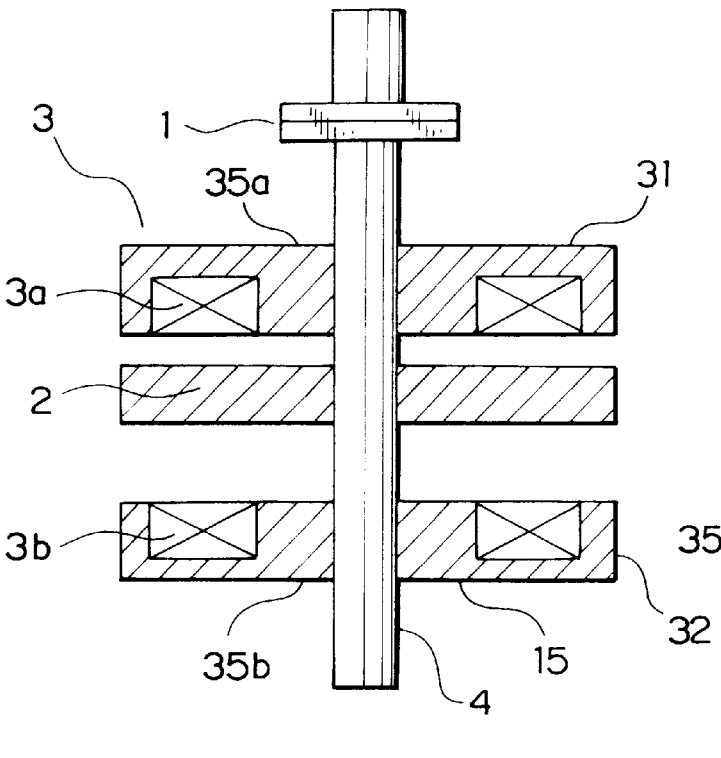

FIGS. 10A and 10B are structural diagrams of an electromagnetic repulsion mechanism which is part of a switching assembly according to Embodiment 6 of the present invention, FIG. 10A showing a closed state of the switching assembly and FIG. 10B showing an open state of the switching assembly.

This embodiment differs from Embodiments 1 to 5 in that it uses a repulsion plate 2 composed of dielectric material having no movable coil on the movable portion.

As in Embodiment 3, the magnetic bodies 35*a* and 35*b* of the first and second fixed portions 31 and 32 include radially inner ring portions 351*a* and 351*b* disposed on the radial inside of the opening and closing coils 3*a* and 3*b,* radially outer ring portions 352*a* and 352*b* disposed on the radial outside, and end surface portions 353*a* and 353*b* in a construction which surrounds the inner and outer radial surfaces and an axial end surface of the opening and closing coils 3*a* and 3*b,* and are disposed so as to generally surround the opening and closing coils 3*a* and 3*b.* End surface portions 353*a* and 353*b* are disposed only on the opposite side from the surface facing the repulsion plate 2.

Naturally, the magnetic bodies may also be constructed so as to be disposed only on the radial inside of the coils 3*a* and 3*b* like the magnetic bodies 15*a* and 15*b* in Embodiment 1, or they may also be disposed on the radial inside and the radial outside of the coils 3*a* and 3*b* like the magnetic bodies 15*a,* 25*a,* 15*b,* and 25*b* in Embodiment 2.

Moreover, the electrical control construction for opening and closing the switch portion 1 may be the same as the one used in FIG. 3.

Next, the opening operation of a switching device of the above construction will be explained.

In the closed state shown in FIG. 10(*a*), a magnetic field is generated when a pulsed current is passed through the opening coil 3*a.* A current is thus induced in the repulsion plate 2 such that a magnetic field is generated in a direction which cancels the magnetic field generated by the opening coil 3*a.* By interaction between the magnetic field generated by the opening coil 3*a* and the magnetic field generated by the repulsion plate 2, the repulsion plate 2 is subjected to electromagnetic repulsion relative to the coil 3*a.* At the same time, the magnetic flux density of the generated magnetic field is intensified in the surrounding space by the magnetic effects of the magnetic body 35*a,* increasing the strength of the magnetic field generated in the surrounding space and also increasing the magnetic field variation. The greater the magnetic field variation, the greater the induced current flowing in the repulsion plate 2, and therefore electromagnetic repulsion arising in the repulsion plate 2 also increases, improving actuation efficiency with a small current. The movable shaft 4 and the movable electrode 5, which are secured to the repulsion plate, are moved down the page in FIG. 10(*a*) by this electromagnetic repulsion and the switch 1 is held in an open state as shown in FIG. 10B.

Next, the closing operation of a switching device of the above construction will be explained.

In the open state shown in FIG. 10B, a magnetic field is generated when a pulsed current is passed through the closing coil 3*b*. A current is thus induced in the repulsion plate 2 such that a magnetic field is generated in a direction which cancels the magnetic field generated by the closing coil 3*b*. By interaction between the magnetic field generated by the closing coil 3*b* and the magnetic field generated by the repulsion plate 2, the repulsion plate 2 is subjected to electromagnetic repulsion relative to the coil 3*b*. At the same time, the magnetic flux density of the generated magnetic field is intensified in the surrounding space by the magnetic effects of the magnetic body 35*b*, increasing the strength of the magnetic field generated in the surrounding space and also increasing the magnetic field variation. The greater the magnetic field variation, the greater the induced current flowing in the repulsion plate 2, and therefore electromagnetic repulsion arising in the repulsion plate 2 also increases, improving actuation efficiency with a small current. The movable shaft 4 and the movable electrode 5, which are secured to the repulsion plate, are moved up the page in FIG. 10B by this electromagnetic repulsion and the switch 1 is held in a closed state as shown in FIG. 10A.

Moreover, because the magnetic bodies 35*a* and 35*b* are disposed so as to cover the opening coil 3*a* and the closing coil 3*b*, not only is the magnetic flux density of the generated magnetic field intensified in the surrounding space by the magnetic effects thereof, increasing the strength of the magnetic field generated in the repulsion plate 2 and increasing electromagnetic repulsion with a small current, but the magnetic bodies 35*a* and 35*b* also function as a mechanism for holding expansion in the coils 3*a* and 3*b*, simplifying the coil-holding mechanism.

Furthermore, the magnetic bodies 35*a* and 35*b* may be separate bodies from the first and second fixed portion support members S2 and S3 shown in FIG. 2, or by constructing the first and second fixed portion support members S2 and S3 as part of the magnetic bodies 35*a* and 35*b*, the same effects as above are achieved and preparation is facilitated.

Embodiment 7

Figure 11:
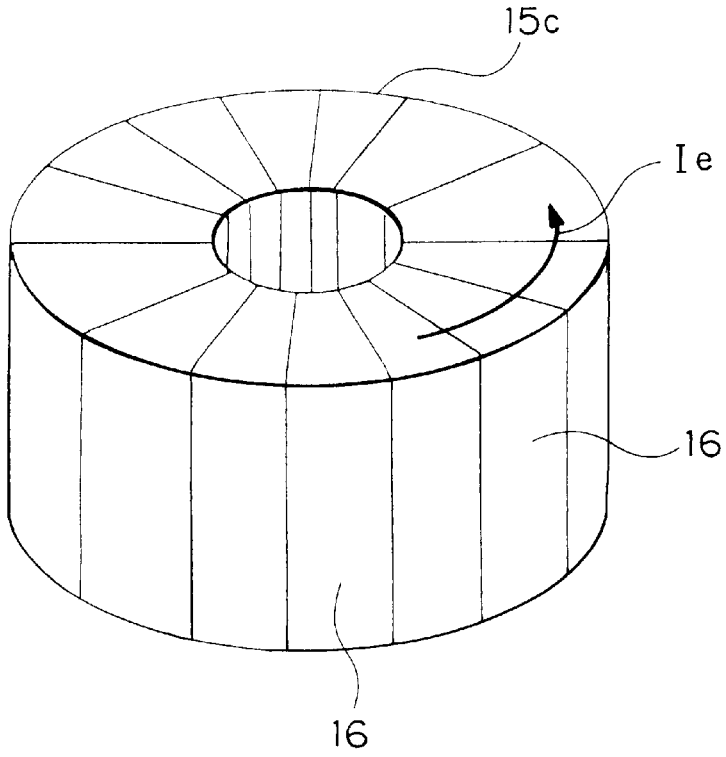
FIG. 11 is a diagram showing the construction of a magnetic body in a switching assembly according to Embodiment 7 of the present invention.

FIG. 11 shows a magnetic body according to Embodiment 7 of the present invention.

In this embodiment, the magnetic bodies disposed in the fixed portions and the movable portions of the switching assemblies used in Embodiments 1 to 6 above are given a laminated construction.

The shape of the magnetic body may be different for each embodiment, and thus the magnetic body 15*c* on the radial inside of the movable portion 14 shown in the drawings for Embodiments 1 and 2 will be used as an example in order to simplify the explanation.

This ring-shaped magnetic body 15*c* is composed of a number of mutually-insulated fan-shaped laminated plates 16 laminated circumferentially. Naturally, this construction can be applied to all of the above Embodiments 1 to 6.

In this embodiment, magnetic fields are generated when pulsed current is passed through the coils 10, 3*a*, and 3*b*, but if the magnetic body 15*c* is also composed of a dielectric material, an induced current le arises on a surface of the magnetic body 15*c*, and a magnetic field is generated at the surface of the magnetic body which is opposite in direction to the magnetic field generated by the movable coil 10, but because the magnetic body 15 is composed of mutually-insulated laminated plates 16, the flow of the induced current le is interrupted. As a result, the generation of a magnetic field which is opposite in direction to the magnetic field generated by the movable coil 10 is suppressed.

FIGS. 4 and 5 also show the results of transient response analyses when the magnetic bodies of Embodiment 1 are given a laminated construction. From these FIGS. 4 and 5, it can be seen that the generated electromagnetic forces relative to the current flowing in the movable coil 10 are greater when the magnetic body 15*c* according to this embodiment is used.

Moreover, there are fourteen laminated plates in FIG. 11, but the number of plates is not limited to that number, and sufficient effect can be achieved by laminating any number of plates sufficient to interrupt the flow of induced current.

Embodiment 8

Figure 12:
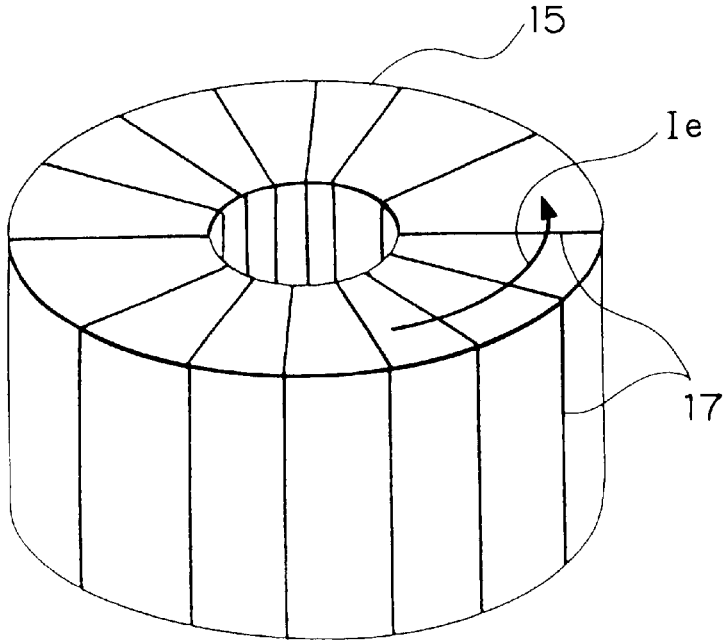
FIG. 12 is a diagram showing the construction of a magnetic body in a switching assembly according to Embodiment 8 of the present invention.

FIG. 12 shows a magnetic body according to Embodiment 8 of the present invention.

The shape of the magnetic body may be different for each embodiment, and thus the magnetic body 15*c* on the radial inside of the movable portion 14 shown in the drawings for Embodiments 1 and 2 will be used as an example in order to simplify the explanation as in Embodiment 7.

The magnetic body 15*c* according to Embodiment 8 improves on the magnetic body 15*c* according to Embodiment 7 by a groove cutting process to the magnetic body instead of the laminated construction.

In this embodiment, a number of grooves 17 of sufficient depth to interrupt the flow of induced current are formed on the surface of the magnetic body 15*c* with circumferential spacing.

In this embodiment, magnetic fields are generated when pulsed current is passed through the coils 10, 3*a*, and 3*b*, but if the magnetic body 15*c* is also composed of a dielectric material, an induced current le arises on a surface of the magnetic body 15*c*, and a magnetic field is generated at the surface of the magnetic body which is opposite in direction to the magnetic fields generated by the coils 10, 3*a*, and 3*b*. This induced current le flows in a direction which hinders the progress of the pulsed magnetic field generated by the movable coil 10 when the magnetic field tries to penetrate the surface of the magnetic body 15*c*. The pulsed magnetic field penetrates the surface of the magnetic body 15*c* to a depth of penetration defined by δ in relation (1), attenuating by 1/e (natural logarithm), and does not penetrate any deeper. Thus, by forming grooves 17 in the surface of the magnetic body 15*c* sufficiently deeper than the depth of penetration δ, it is possible to achieve the same effects as the lamination described in Embodiment 7.

$$\delta=(2/\omega.\sigma.\mu_o.\mu_m)^{1/2} \qquad \text{relation (1)}$$

where:

δ is the depth of penetration;

ω is 2πf (where f is the frequency);

σ is the conductivity of the magnetic body;

$\mu_o$ is the permeability of a vacuum ($4\pi\times10^{-7}$); and $\mu_m$ is the relative permeability of the magnetic body.

For example, if f=100 Hz, $\sigma=10^7$ s/m, and $\mu$m=2400, then δ=0.3 mm.

Furthermore, only groove cutting has been performed on the magnetic body 15*c* of this embodiment, enabling the strength of the magnetic body 15*c* to be maintained. Also, there are fourteen grooves 17 in FIG. 12, but the number of plates is not limited to that number, and sufficient effect can be achieved by cutting any number of grooves sufficient to interrupt the flow of induced current.

Moreover, in FIG. 12, the grooves 17 are formed in all surfaces including the outer circumferential surface, the top, the bottom, and the inner circumferential surface, but it goes without saying that it is not necessary to cut the grooves in all of these surfaces and that the same effects can be achieved by cutting the grooves only in the surfaces in which the penetrating magnetic field is great.

Embodiment 9

Figure 13:
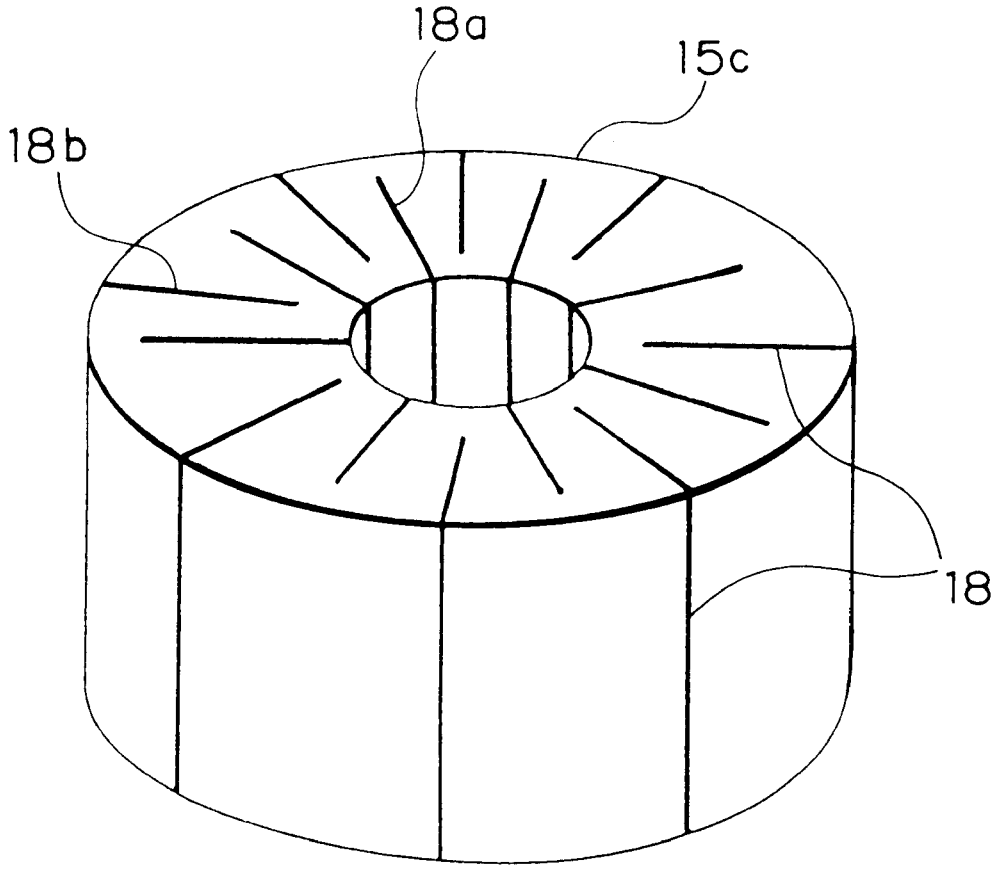
FIG. 13 is a diagram showing the construction of a magnetic body in a switching assembly according to Embodiment 9 of the present invention.

FIG. 13 shows a magnetic body 15*c* according to Embodiment 9 of the present invention.

Embodiment 9 improves on the magnetic body 15*c* according to Embodiment 8 by disposing slits instead of the grooves 17, the slits having narrower width than the grooves 17. In this embodiment, slits 18*a* extending radially outwards from the radial inside, and slits 18*b* extending radially inwards from the radial outside, are formed alternately lengthwise on the top and bottom surfaces of the magnetic body 15.

In this embodiment, disposing slits 18*a* extending radially outwards from the radial inside, and slits 18*b* extending radially inwards from the radial outside, alternately on the top and bottom surfaces of the magnetic body 15*c,* as shown in FIG. 13, is easier than the overall groove cutting described in Embodiment 8, enabling machining costs to be reduced, and improving the strength of the magnetic body 15*c*.

Moreover, in FIG. 13, the slits 18*a* and 18*b* are formed in all surfaces including the outer circumferential surface, the top, the bottom, and the inner circumferential surface, but it goes without saying that it is not necessary to cut the slits in all of these surfaces and that the same effects can be achieved by cutting the slits only in the surfaces in which the penetrating magnetic field is great.

Embodiment 10

Figure 14:
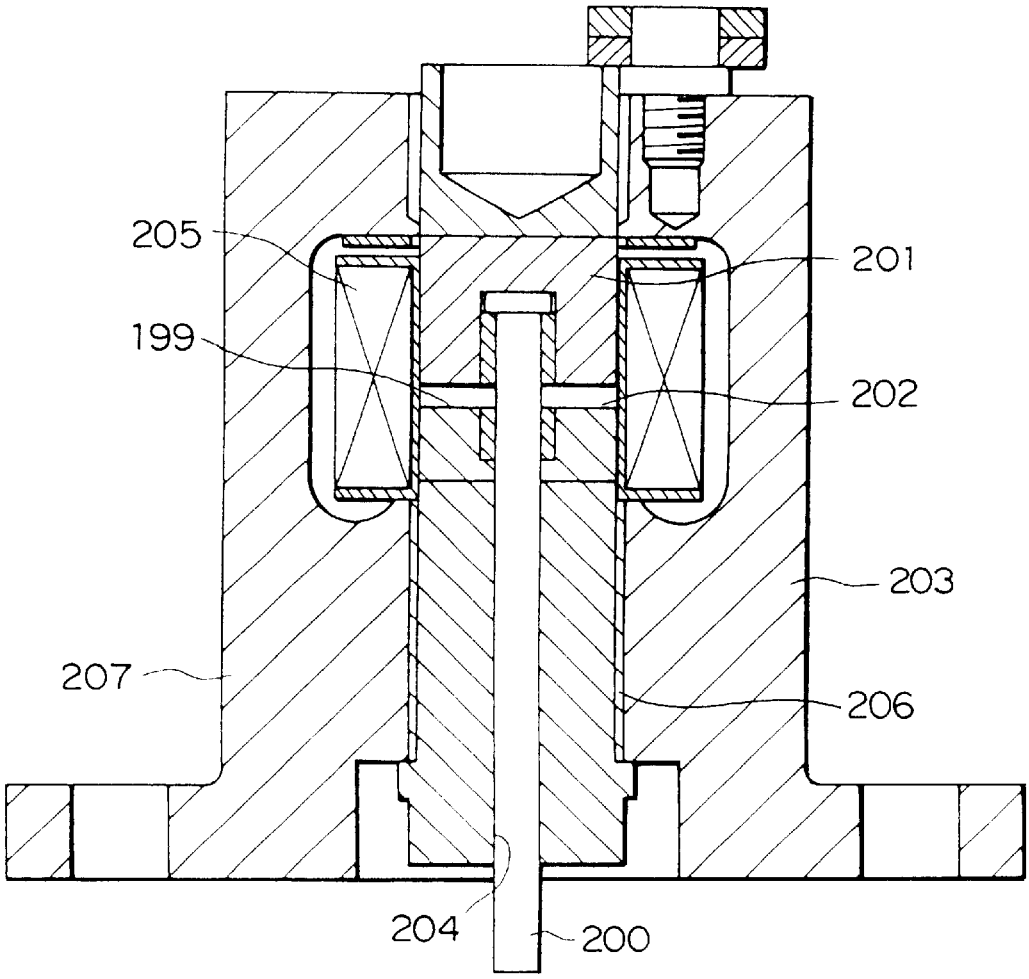
FIG. 14 is a partial cross section of a switching assembly according to Embodiment 10 of the present invention.

FIG. 14 is a partial cross section of a switching assembly according to Embodiment 10 of the present invention.

This switching assembly includes:

a movable shaft 200 having an I-shaped cross section;

a movable body 201 having a magnetic body secured to an end portion of the movable shaft;

a fixed body 203 disposed opposite the movable body 201 across an air gap portion 202, the fixed body 203 being formed with a passage bore 204 in a central portion through which the movable shaft 200 slides;

a coil 205 surrounding the movable body 201 and the fixed body 203;

an iron core 207 surrounding the coil 205 and the fixed body 203, the fixed body 203 being fastened to the iron core 207 by a thread portion 206; and a washer 199 composed of non-magnetic material mounted on an end surface of the fixed body 203, the washer 199 canceling residual magnetization in the fixed body 203. Moreover, the fixed body 203 and the iron core 207 may also be formed into one body.

Figure 15:
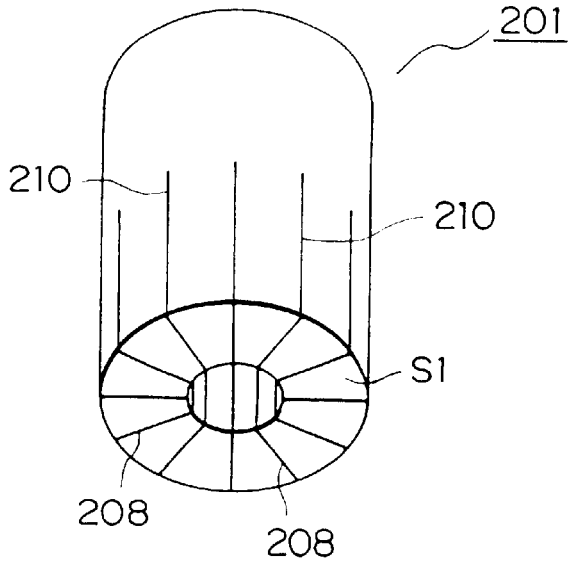
FIG. 15 is a perspective of the movable body in FIG. 14.
Figure 16:
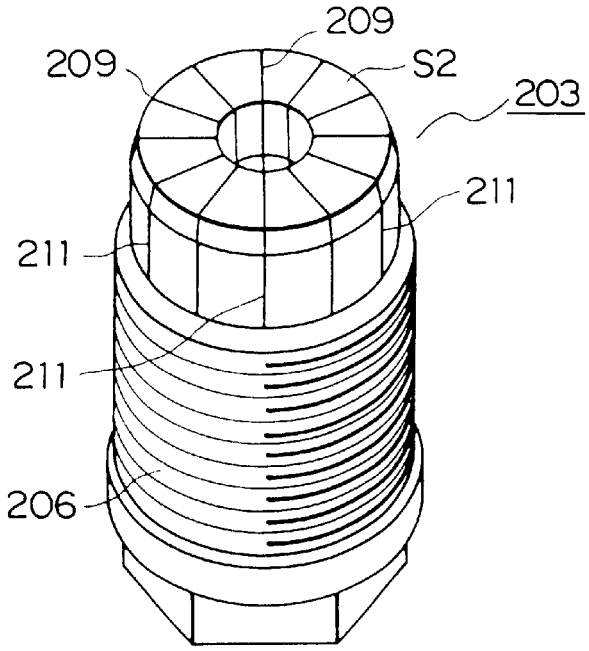
FIG. 16 is a perspective of the fixed body in FIG. 14.

FIG. 15 is a perspective of the movable body 201 in FIG. 14, and FIG. 16 is a perspective of the fixed body 203 in FIG. 14. Slits 208 and 209 are formed in the opposing surfaces S1 and S2 of the movable body 201 and the fixed body 203, respectively. The slits 208 in the movable body 201 and the slits 209 in the fixed body 203 are cut such that the depth is sufficiently deeper than the depth of electromagnetic penetration into the movable body 201 and the fixed body 203 in each case.

Furthermore, the ratio which the slits 208 occupy in the opposing surface S1 of the movable body 201 is twenty percent or less, and the ratio which the slits 209 occupy in the opposing surface S2 of the fixed body 203 is also twenty percent or less.

In addition, slits 210 extending longitudinally from the slits 208 are formed in the circumferential side surfaces of the movable body 201. The length of these slits 210 is approximately half the total length of the movable body 201. Slits 211 extending longitudinally from the slits 209 are formed in the circumferential side surfaces of the fixed body 203. The length of these slits 211 is approximately one quarter of the total length of the fixed body 203.

Next, the contact opening operation of a switching device of the above construction will be explained.

A magnetic field is generated when a constant is applied to the coil 205, and this magnetic field forms a closed magnetic pathway crossing to the opposing surface S2 of the fixed body 203 via the movable body 201 composed of a magnetic body, the opposing surface S1 of the movable body 201, and the air gap portion 202 and then returning to the movable body 201 via the fixed body 203 and the iron core 207. At that time, magnetic attraction arises due to interaction between the magnetic fields generated in the air gap portion 202 between the opposing surface S1 of the movable body 201 and the opposing surface S2 of the fixed body 203, and the movable shaft 200 which is integrated with the movable body 201 is moved by this magnetic attraction in opposition to the elastic force of an elastic member (not shown) mounted on an end portion of the movable shaft 200. Thus, a movable electrode (not shown) connected by means of a connecting member to an end portion of the movable shaft 200 is separated from a fixed electrode (not shown), for example, opening the contacts of the switching assembly.

When the electric current in the coil 205 is interrupted, the movable body 201 is demagnetized and the movable shaft 200 integrated with the movable body 201 is returned to its original position by the elastic force of the elastic member, closing the contacts of the switching assembly.

In this embodiment, because the slits 208 in the movable body 201 and the slits 209 in the fixed body 203 are cut such that the depth is sufficiently deeper than the depth of electromagnetic penetration into the movable body 201 and the fixed body 203 in each case, the generation of induced currents in the opposing surface S1 of the movable body 201 and the opposing surface S2 of the fixed body 203 is suppressed, reducing loss of electromagnetic attraction so that the establishment of electromagnetic attraction is accelerated.

Figure 17:
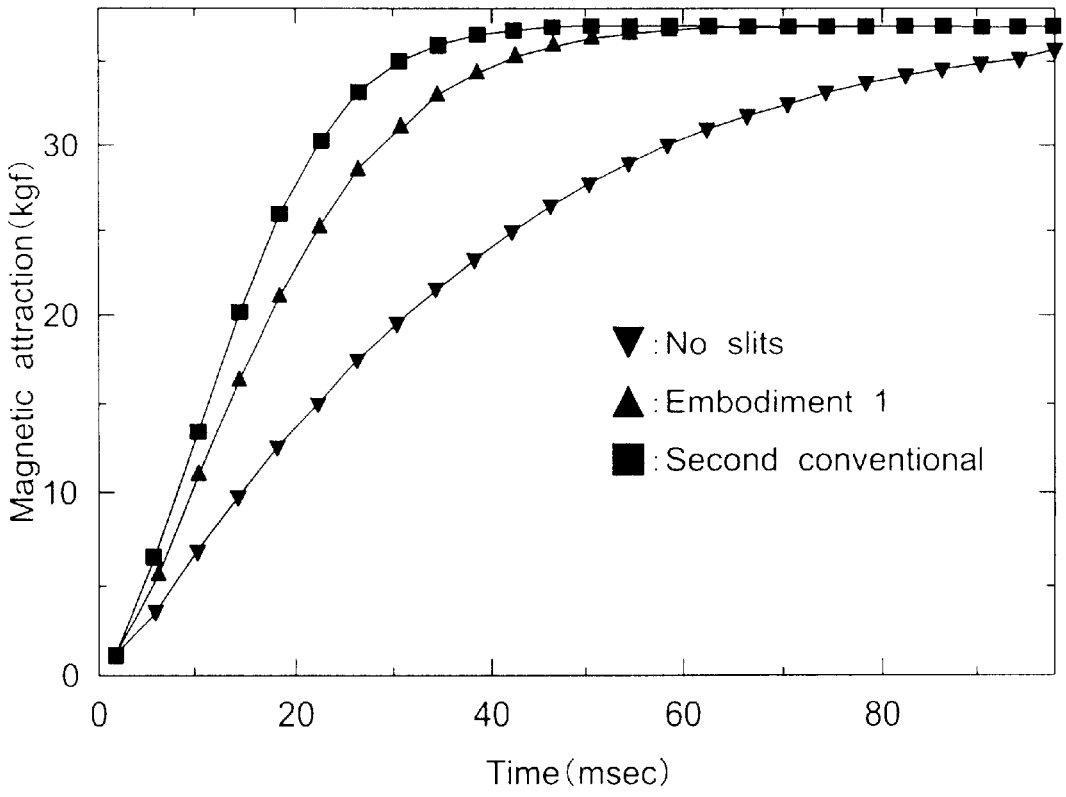
FIG. 17 is a graph showing change in magnetic attraction over time obtained by analysis of transient response electromagnetic fields by the present inventors.

FIG. 17 is a graph showing change in magnetic attraction over time obtained by analysis of transient response electromagnetic fields by the present inventors, and it can be seen from this graph that the establishment of electromagnetic attraction is accelerated and the value of the electromagnetic attraction is greater than the example which is not provided with slits.

Moreover, FIG. 18 is a table showing the relationship between the ratio of space (S %) occupied by the slits 208 and 209 in the opposing surfaces of the movable body 201 and the fixed body 203, and contact opening time (T) (the time taken for the opposing surface S1 of the movable body 201 to contact the opposing surface S2 of the fixed body 203). From this table, it can be seen that when the area occupied by the slits is twenty percent or less, the opening time is short, and in excess thereof, the opening time is long. That is because, although the generation of induced currents is suppressed by the provision of slits, in excess of twenty percent, the opposing surfaces S1 and S2 of the movable body 201 and the fixed body 203 reach magnetic saturation, reducing the effective magnetic field.

FIG. 19 is a table showing the relationship between the length of the slits 210 and 211 in the circumferential surfaces of the movable body 201 and the fixed body 203, and magnetic attraction (F) between the movable body 201 and the fixed body 203. Moreover, the values in FIG. 19 are for an example in which the area occupied by the slits 208 and 209 in the opposing surface S1 of the movable body 201 and the opposing surface S2 of the fixed body 203 is twenty percent. From this table it can be seen that when the slit length ratio L (the ratio of the length of the slits 210 and 211 to the total length of the movable body 201 and the fixed body 203) is between zero and approximately one half, the drop in magnetic attraction is small. That is because, although the generation of induced currents is suppressed by the provision of slits, in excess of one half, the circumferential surfaces of the movable body 201 and the fixed body 203 reach magnetic saturation, reducing the effective magnetic field.

Embodiment 11

Figure 20:
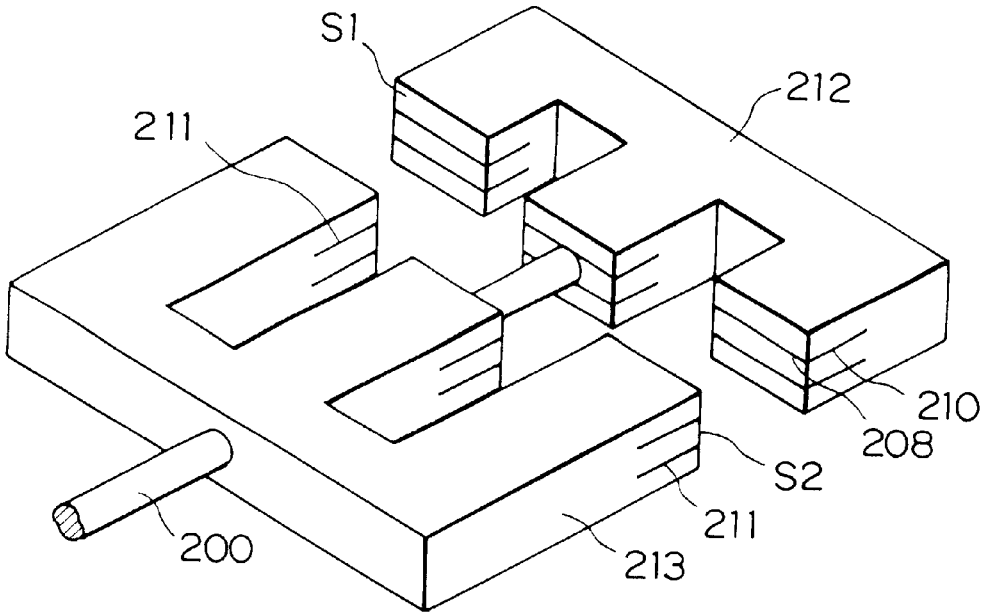
FIG. 20 is a partial perspective of a switching assembly according to Embodiment 11 of the present invention.

FIG. 20 is a partial perspective of a switching assembly according to Embodiment 11 of the present invention, which differs from Embodiment 10 in that the overall shapes of a movable body 212 and a fixed body 213 are E shapes.

In this embodiment, the opposing surface S1 of the movable body 212 and the opposing surface S2 of the fixed body 213 are raised and recessed, enabling a larger electromagnetic attraction to be achieved than in Embodiment 10 by increasing the area of the opposing surfaces S1 and S2. Furthermore, the movable body 212 and the fixed body 213 are flat, reducing dimensions in the thickness direction and enabling the entire assembly to be made more compact.

Embodiment 12

Figure 21:
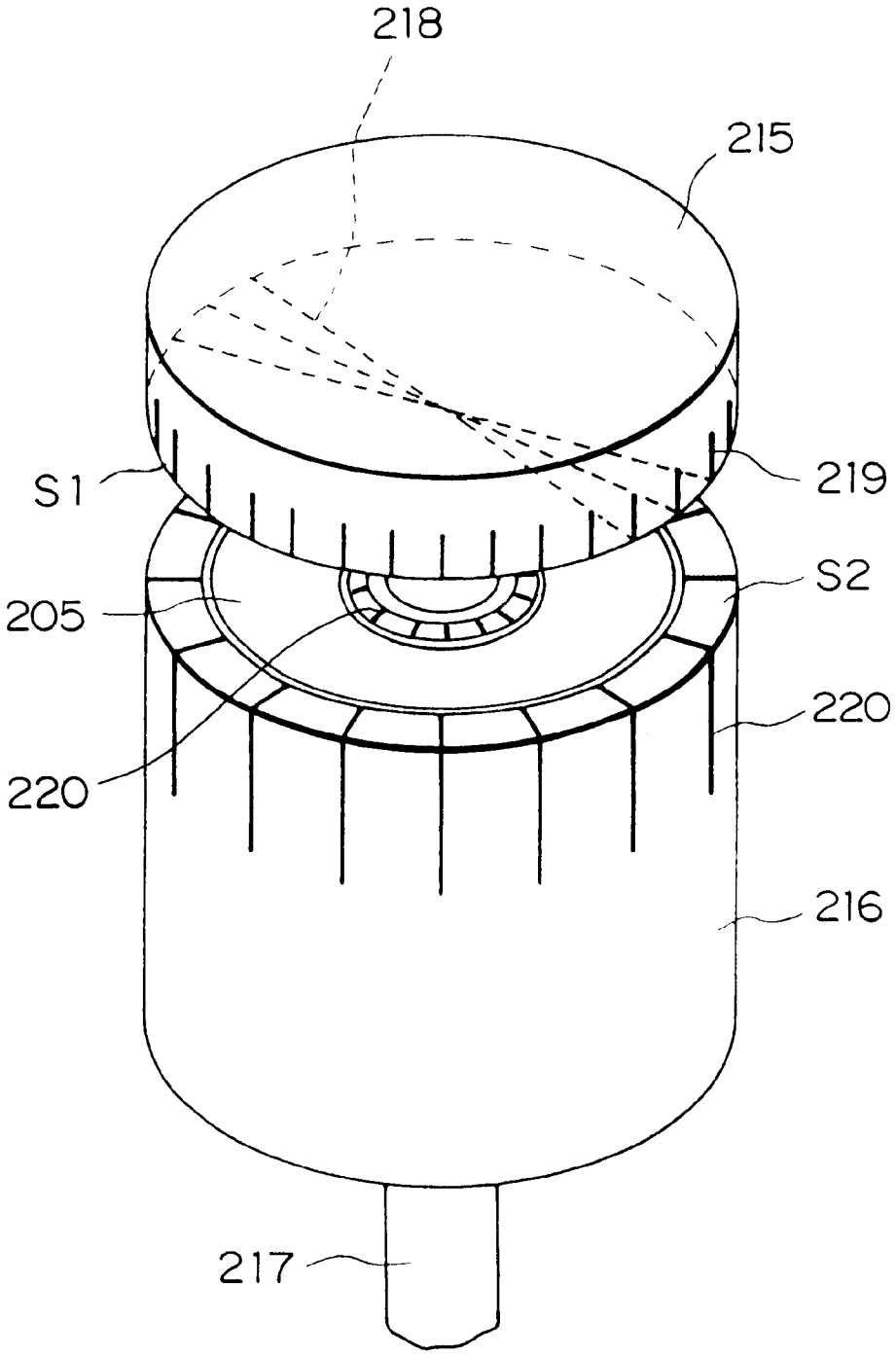
FIG. 21 is a partial perspective of a switching assembly according to Embodiment 12 of the present invention.
Figure 22:
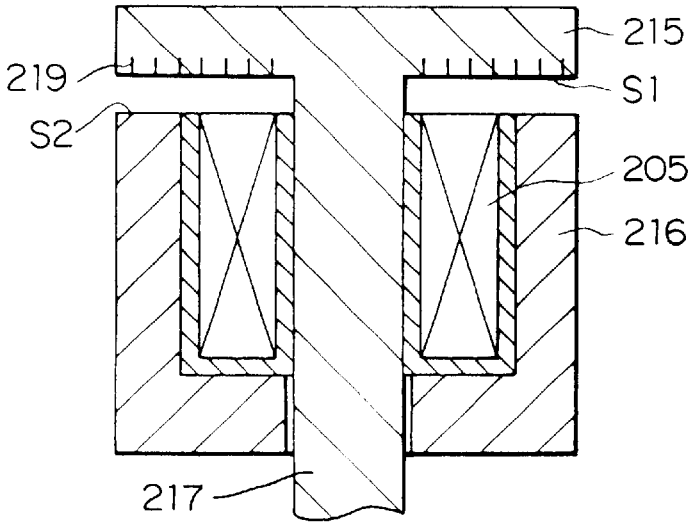
FIG. 22 is a cross section of a variation of Embodiment 12 of the present invention.

FIG. 21 is a partial perspective of a switching assembly according to Embodiment 12 of the present invention, and FIG. 22 is a cross section of a variation of Embodiment 12 of the present invention. A movable body 215 and a movable shaft 217 are integrally formed from a magnetic material. The movable body 215 is disk-shaped, and slits 218 and 219 are formed in an opposing surface S1 and in a circumferential surface of the movable body 215. The depth of the slits 218 and 219 is cut so as to be sufficiently deeper than the depth of penetration of the movable body 215.

The movable shaft 217 passes through a central portion of a floored, cylindrical fixed body 216 composed of magnetic material. A coil 205 is disposed inside this fixed body 216. Slits 220 which are sufficiently deeper than the depth of penetration of the fixed body 216 are formed on the side of the fixed body 216 facing the movable body 215.

In this embodiment, the area of an opposing surface S1 of the movable body 215 and the area of an opposing surface S2 of the fixed body 216 are increased, enabling the achievement of greater electromagnetic attraction and making high-speed actuation possible. Furthermore, the movable shaft 217 and the movable body 215 are integrated, simplifying preparation thereof. Also, the fixed body 216 is cylindrical, enabling manufacture at low cost by making preparation of the construction easier.

Moreover, the movable shaft 217 may also be composed of nonmagnetic material, the movable shaft 215 composed of magnetic material, and the two constructed as separate parts.

Embodiment 13

Figure 23:
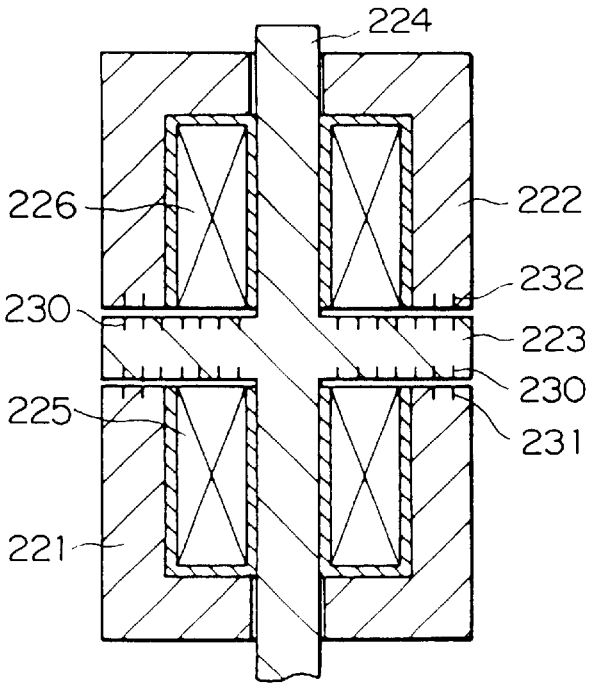
FIG. 23 is a partial cross section of a switching assembly according to Embodiment 13 of the present invention.
Figure 24B:
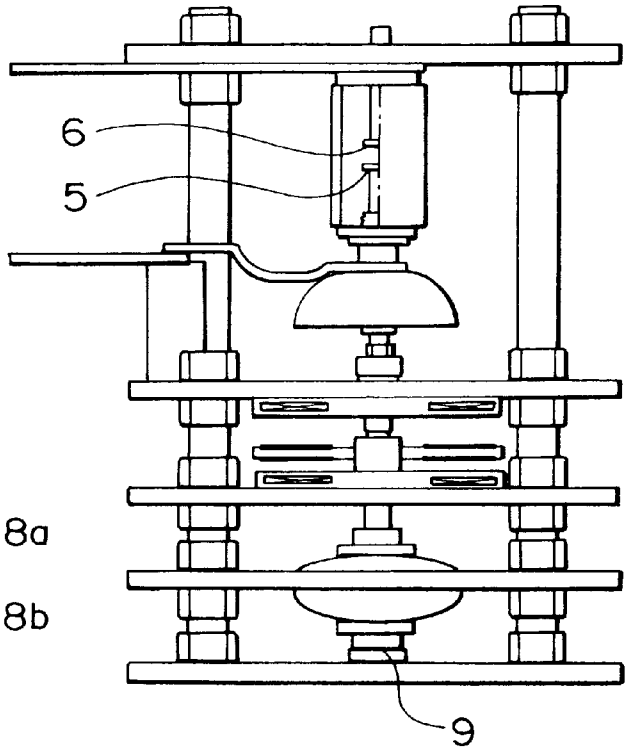
FIG. 24B (PRIOR ART)
FIGS. 24A and 24B are structural diagrams of a switching assembly which is a first conventional example, 24A showing a closed state and 24B showing an open state.
Figure 24A:
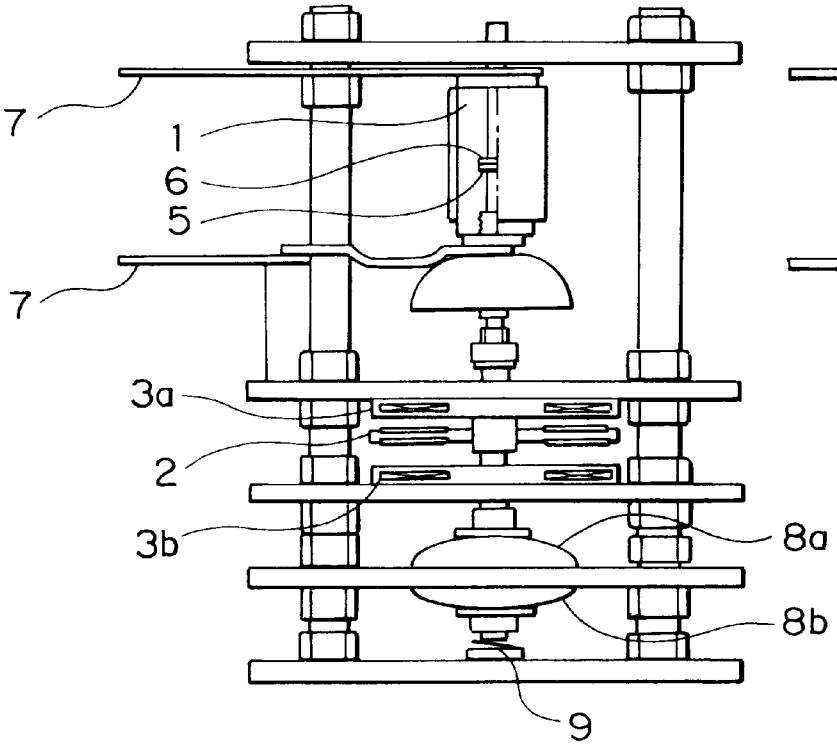
FIG. 24A (PRIOR ART)
Figure 25:
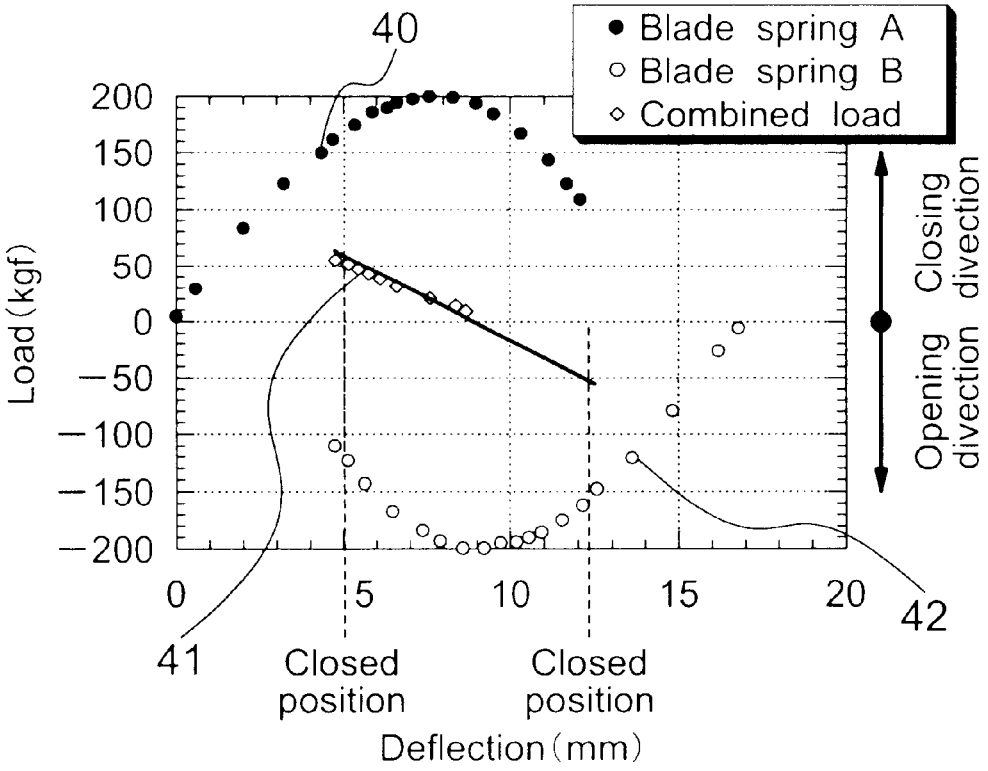
FIG. 25 (PRIOR ART)
FIG. 25 is a graph showing the load characteristics of contact pressure input springs used in the switching assembly according to the first conventional example.
Figure 26:
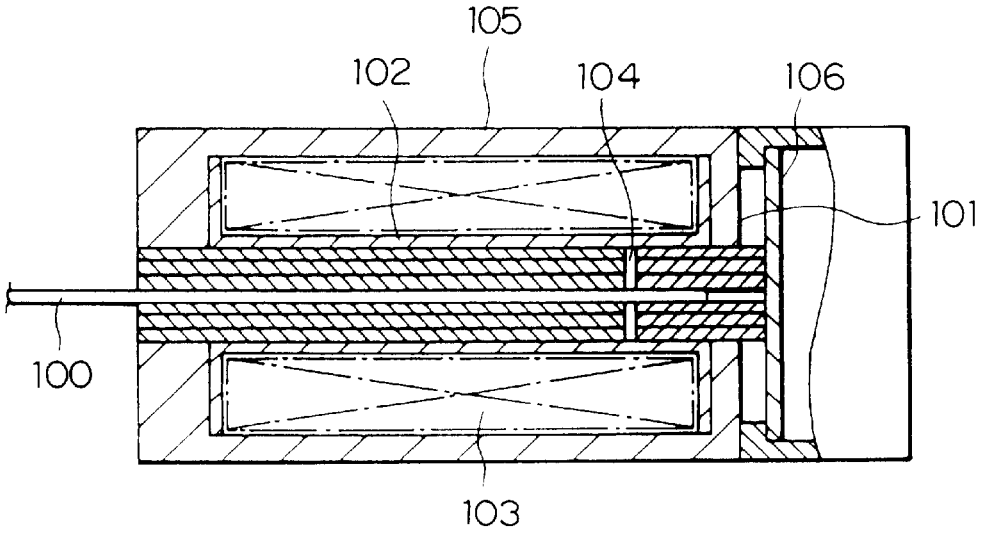
FIG. 26 (PRIOR ART)
FIG. 26 is a partial cross section of a switching assembly which is a second conventional example.
Figure 27:
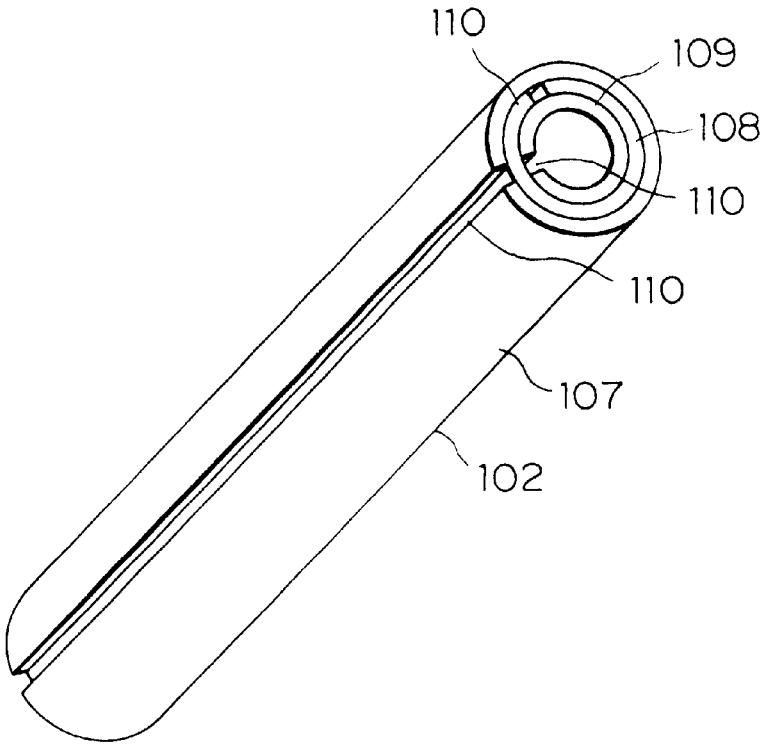
FIG. 27 (PRIOR ART)
FIG. 27 is a perspective of the fixed body in FIG. 26.
Figure 28:
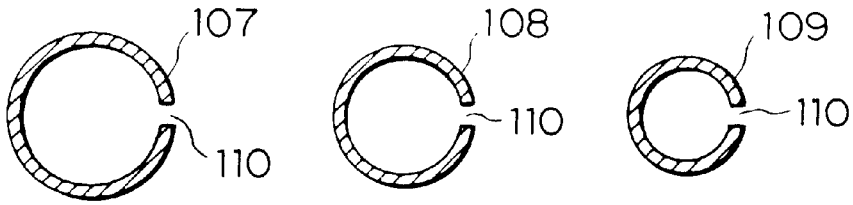
FIG. 28 (PRIOR ART)
FIG. 28 shows cross sections of structural elements of the fixed body in FIG. 26.

FIG. 23 is a partial cross section of a switching assembly according to Embodiment 13 of the present invention. In this embodiment, a disk-shaped movable body 223 and a movable shaft 224 are formed integrally. Slits 230 are formed in an upper surface, a lower surface, and a circumferential surface of the movable body 223. The depth of the slits 230 is cut so as to be sufficiently deeper than the depth of penetration of the movable body 223. Moreover, as in the switching assembly in FIG. 21, part of a fixed body may also be disposed between a movable shaft 217 and a coil 205.

The movable shaft 224 passes through a central portion of a floored, cylindrical first fixed body 221 composed of magnetic material. A first coil 225 is disposed inside this first fixed body 221. Slits 231 which are sufficiently deeper than the depth of penetration of the first fixed body 221 are formed on the side of the first fixed body 221 facing the movable body 223. The movable shaft 224 also passes through a central portion of a floored, cylindrical second fixed body 222 composed of magnetic material. A second coil 226 is disposed inside this second fixed body 222. Slits 232 which are sufficiently deeper than the depth of penetration of the second fixed body 222 are formed on the side of the second fixed body 222 facing the movable body 223.

In this embodiment, the generation of eddy currents is suppressed by the slits 230, 231, and 232, and by passing current through the first coil 225 and the second coil 226, a large electromagnetic force can be achieved between the first fixed body 221 and the movable body 223 and between the second fixed body 222 and the movable body 223, making high-speed actuation possible.

Moreover, the movable body 223 and the movable shaft 224 may also be constructed as separate members and the two members may be joined.

Moreover, the above embodiments have been explained with reference to a switching assembly, but naturally the present invention can also be applied to any device requiring high-speed actuation, such as an automotive engine valve, for example.

As explained above, a switching assembly according to one aspect of the present invention comprises: a switch portion comprising a fixed electrode and a movable electrode which are separable; a movable shaft moving together with the movable electrode; a movable portion having a magnetic body secured to the movable shaft and a movable coil surrounding an outer side of the magnetic body; and a fixed portion having a magnetic body slidably disposed on the movable shaft and a fixed coil surrounding an outer side of the magnetic body, the fixed portion being disposed opposite the movable portion, the fixed electrode and the movable electrode being separable by moving the movable portion and the movable shaft by electromagnetic force acting between the movable coil and the fixed coil, the electromagnetic force being generated by passage of excitation current through the movable coil and the fixed coil. Therefore, electromagnetic actuation can be made highly efficient, and a high-speed switching operation can be ensured.

According to one form of the switching assembly, a magnetic body may be disposed surrounding an outer side of the movable coil; and a magnetic body may be disposed surrounding an outer side of the fixed coil. Therefore, electromagnetic actuation can be made highly efficient by using a magnetic body on radially outside and radially inside the coils of the movable portion and the fixed portion, and the coil support construction can be simplified.

According to another aspect of the present invention, a switching assembly comprises: a switch portion comprising a fixed electrode and a movable electrode which are separable; a movable shaft moving together with the movable electrode; a movable portion having a movable coil and a magnetic body covering the movable coil, the movable portion being secured to the movable shaft; and a fixed portion having a fixed coil and a magnetic body covering the fixed coil, the fixed portion being disposed opposite the movable portion, the fixed electrode and the movable electrode being separable by moving the movable portion and the movable shaft by electromagnetic force acting between the movable coil and the fixed coil, the electromagnetic force being generated by passage of excitation current through the movable coil and the fixed coil. Therefore, electromagnetic actuation can be made highly efficient, and the magnetic material can be used as both a winding frame and a container for the coil, improving manufacture.

According to one form of the switching assembly, the switching assembly may comprise: a power source for passing the excitation current to the movable coil and the fixed coil; and a current direction setting means for setting a direction of the excitation current from the power source to the movable coil and the fixed coil such that interaction of magnetic fields arises between the movable coil and the fixed coil during opening and closing of the switch portion. Therefore, the capacity of the opening power source or the closing power source can be reduced.

According to another form of the switching assembly, the fixed portion may comprise a first fixed portion and a second fixed portion each having a magnetic body and a fixed coil, the first fixed portion and the second fixed portion being disposed opposite the movable portion on both sides of the movable portion in an axial direction; and the current direction setting means may be designed such that when the excitation current is passed from the power source to the movable coil and the fixed coil of the first fixed portion during opening of the switch portion, the current direction is set to pass current from the power source to the fixed coil of the first fixed portion and the movable coil such that magnetic repulsion arises between the movable coil and the fixed coil of the first fixed portion, and when the excitation current is passed from the power source to the movable coil and the fixed coil of the second fixed portion during closing of the switch portion, the current direction is set to pass current from the power source to the fixed coil of the second fixed portion and the movable coil such that magnetic repulsion arises between the movable coil and the fixed coil of the second fixed portion. Therefore, magnetic repulsion can be generated efficiently by interaction between the magnetic fields generated in the movable coil and the fixed coil.

According to still another form of the switching assembly, the fixed portion may be disposed opposite the movable portion on only one side of the movable portion in an axial direction; and the current direction setting means may be designed such that when the excitation current is passed from the power source to the movable coil and the fixed coil during opening of the switch portion, the current direction is set to pass current from the power source to the movable coil and the fixed coil such that magnetic repulsion arises between the movable coil and the fixed coil, and when the excitation current is passed from the power source to the movable coil and the fixed coil during closing of the switch portion, the current direction is set to pass current from the power source to the movable coil and the fixed coil such that magnetic attraction arises between the movable coil and the fixed coil. Therefore, electromagnetic actuation can be made highly efficient, and the number of operating coils can be reduced, reducing the overall size of the assembly.

According to another aspect of the present invention, a switching assembly comprises: a fixed electrode and a movable electrode which are separable; a movable shaft moving together with the movable electrode; a movable portion comprising a dielectric body secured to the movable shaft; and a first fixed portion and a second fixed portion each having a magnetic body and a fixed coil, the first fixed portion and the second fixed portion being disposed opposite the movable portion on both sides of the movable portion in an axial direction, the fixed electrode and the movable electrode being separable by moving the movable portion and the movable shaft by electromagnetic force acting between the movable portion and the first fixed portion and between the movable portion and the second fixed portion, the electromagnetic force being generated by passage of excitation current through the fixed coil of the first fixed portion and the fixed coil of the second fixed portion. Therefore, electromagnetic actuation can be made efficient by using the magnetic body to surround the fixed coil.

According to another form of the switching assembly, the switching assembly may comprise: a power source for passing the excitation current to the fixed coil of the first fixed portion and the fixed coil of the second fixed portion; a setting means for passing current from the power source to the fixed coil of the first fixed portion such that a magnetic field is generated in the fixed coil of the first fixed portion during opening of the switch portion; and a setting means for passing current from the power source to the fixed coil of the second fixed portion such that a magnetic field is generated in the fixed coil of the second fixed portion during closing of the switch portion. Therefore, the capacity of the opening power source or the closing power source can be reduced.

According to still another form of the switching assembly, the magnetic body may have a laminated construction in which a number of laminar plates are stacked. Therefore, electromagnetic actuation can be made highly efficient by reducing weak magnetic fields due to induced currents generated in the magnetic bodies, making high-speed operation of the switch possible, and enabling the capacity of the opening power source or the closing power source to be reduced.

According to another form of the switching assembly, at least one groove may be formed in a surface of the magnetic body disposed in at least one the fixed portion or the movable portion, depth of the groove being sufficient to cancel a weak magnetic field generated in the magnetic body by induced current. Therefore, electromagnetic actuation can be made highly efficient by reducing weak magnetic fields due to induced currents generated in the magnetic bodies, making high-speed operation of the switch possible, and enabling the capacity of the opening power source or the closing power source to be reduced by maintaining the strength of the magnetic bodies.

According to still another form of the switching assembly, slits may be formed in a surface of the magnetic body disposed in at least one the fixed portion or the movable portion such that slits extending from a radially inner side towards a radially outer side alternating with slits extending from the radially outer side towards the radially inner side. Therefore, electromagnetic actuation can be made highly efficient by reducing weak magnetic fields due to induced currents generated in the magnetic bodies, making high-speed operation of the switch possible, and enabling the capacity of the opening power source or the closing power source to be reduced by maintaining the strength of the magnetic bodies and facilitating manufacture.

According to another aspect of the present invention, a switching assembly comprising: a switch portion comprising a fixed electrode and a movable electrode which are separable; a movable shaft moving together with the movable electrode; a movable body secured to the movable shaft; a fixed body disposed opposite the movable body, the fixed body being slidable relative to the movable shaft; and a coil for contacting and separating the fixed body and the movable body by means of electromagnetic force generated by passage of electric current, slits for suppressing eddy currents being formed in at least one opposing surface of the movable body or the fixed body. Therefore, the speed of the magnetic actuation can be increased and a high-speed switching operation is ensured, enabling the capacity and size of the opening power source or the closing power source to be reduced.

According to another form of the switching assembly, an occupation ratio occupied by the slits on the opposing surface may be twenty percent or less. Therefore, since the magnetic saturation of the opposing faces of the movable body and the fixed body can be maintained in generally the same state as before the construction of slits, the speed of the magnetic actuation can be increased and a high-speed switching operation is ensured without reducing electromagnetic force between the movable body and the fixed body, enabling the capacity and size of the opening power source or the closing power source to be reduced.

According to still another form of the switching assembly, slits extending longitudinally up to a length which is one half to one quarter of a total length of the fixed body may be formed in a side surface of the fixed body extending perpendicular to the opposing surface of the fixed body. Therefore, since the magnetic saturation of the opposing face of the fixed body can be maintained in generally the same state as before the construction of slits, the speed of magnetic actuation can be increased and a high-speed switching operation is ensured without reducing electromagnetic force between the movable body and the fixed body, enabling the capacity and size of the opening power source or the closing power source to be reduced.

According to another form of the switching assembly, slits extending longitudinally up to a length which is one half to one quarter of a total length of the movable body may be formed in a side surface of the movable body extending perpendicular to the opposing surface of the movable body. Therefore, since the magnetic saturation of the opposing face of the movable body can be maintained in generally the same state as before the construction of slits, the speed of the magnetic actuation can be increased and a high-speed switching operation is ensured without reducing electromagnetic force between the movable body and the fixed body, enabling the capacity and size of the opening power source or the closing power source to be reduced.

According to still another form of the switching assembly, the movable body may have an I-shaped cross section. Therefore, preparation is simplified and the weight of the movable body can be reduced, ensuring a high-speed switching operation and enabling the capacity and size of the opening power source or the closing power source to be reduced.

According to another form of the switching assembly, the movable body may have an E-shaped cross section. Therefore, since electromagnetic force between the movable body and the fixed body can be increased by increasing the surface area of the movable body opposing the fixed body, the speed and efficiency of magnetic actuation can be increased and a high-speed switching operation is ensured, enabling the capacity and size of the opening power source or the closing power source to be reduced.

According to another form of the switching assembly, the movable body may have a T-shaped cross section integrated with the movable shaft. Therefore, since electromagnetic force between the movable body and the fixed body can be increased by increasing the surface area of the movable body opposing the fixed body, the speed and efficiency of magnetic actuation can be increased and a high-speed switching operation is ensured, enabling the capacity and size of the opening power source or the closing power source to be reduced.

According to still another form of the switching assembly, the fixed body may have an E-shaped cross section. Therefore, since electromagnetic force between the movable body and the fixed body can be increased by increasing the surface area of the movable body opposing the fixed body, the speed and efficiency of magnetic actuation can be increased and a high-speed switching operation is ensured, enabling the capacity and size of the opening power source or the closing power source to be reduced.

According to another form of the switching assembly, the fixed body may have a cylindrical shape. Therefore, manufacture of the fixed body may be facilitated.

According to still another form of the switching assembly, the fixed body may comprise a first fixed body and a second fixed body disposed on opposite sides of a flat movable body, the movable shaft passing through a central portion of the movable body; and the coil may comprise a first coil disposed inside the first fixed body and a second coil disposed inside the second fixed body. Therefore, a large electromagnetic force can be achieved between the first fixed body and the movable body and between the second fixed body and the movable body by passing current through the first coil and the second coil, enabling the speed and efficiency of magnetic actuation to be increased and ensuring a high-speed switching operation, thereby enabling the capacity and size of the opening power source or the closing power source to be reduced.

According to another form of the switching assembly, the movable shaft and the movable body may be formed integrally from the same material. Therefore, the movable shaft and the movable body can be manufactured simply and at low cost.

What is claimed is:

1. A switching assembly comprising:

a switch portion comprising a fixed electrode and a movable electrode which may be separated from each other;

a movable shaft moving together with said movable electrode;

a movable portion having a first magnetic body secured to said movable shaft and a movable coil surrounding said first magnetic body; and a fixed portion having a second magnetic body surrounding said movable shaft and a fixed coil surrounding said second magnetic body, wherein said movable shaft passes through and slides relative to said fixed portion, said fixed portion is disposed opposite said moving portion, said fixed electrode and said movable electrode are separated from each other by movement of said movable portion and said movable shaft in response to an electromagnetic force acting between said movable coil and said fixed coil, and the electromagnetic force is generated by passage of an excitation current through said movable coil and said fixed coil.

2. The switching assembly according to claim 1 including:

a third magnetic body surrounding said movable coil; and a fourth magnetic body surrounding said fixed coil.

3. A switching assembly according to claim 1 comprising:

a power source for passing the excitation current to said movable coil and said fixed coil; and a current direction setting means for controlling direction of the excitation current flow from said power source to said movable coil and said fixed coil such that interaction of magnetic fields arises between said movable coil and said fixed coil during opening and closing of said switch portion.

4. The switching assembly according to claim 3 wherein:

said fixed portion comprises first and second fixed portions having respective magnetic bodies and fixed coils, said first and second fixed portions being disposed opposite said movable portion and on opposite sides of said movable portion, in an axial direction; and when the excitation current passes from said power source to said movable coil and said fixed coil of said first fixed portion during opening of said switch portion, said movable coil and said fixed coil of said first fixed portion are magnetically repelled from each other, and when the excitation current passes from said power source to said movable coil and said fixed coil of said second fixed portion during closing of said switch portion, said movable coil and said fixed coil of said second fixed portion are magnetically repelled from each other.

5. The switching assembly according to claim 3 wherein:

said fixed portion is disposed opposite said movable portion on only one side of said movable portion, in an axial direction; and when the excitation current passes from said power source to said movable coil and said fixed coil during opening of said switch portion, said movable coil and said fixed coil are magnetically repelled from each other, and when the excitation current passes from said power source to said movable coil and said fixed coil during closing of said switch portion, said movable coil and said fixed coil of said second fixed portion are magnetically attracted to each other.

6. The switching assembly according to claim 1 wherein said first and second magnetic bodies have a laminated construction including stacked laminar plates.

7. The switching assembly according to claim 1 wherein at least one of said first and second magnetic bodies includes at least one groove in a surface of at least one of said fixed portion and said movable portion, the groove having a depth sufficient to cancel a magnetic field generated by an induced current in said magnetic body including the groove.

8. The switching assembly according to claim 1 wherein at least one of said first and second magnetic bodies includes slits in a surface of at least one of said fixed portion and said movable portion, the slits alternately extending from a radial inner side towards a radially outer side and from said radially outer side towards said radially inner side.

9. A switching assembly comprising:

a switch portion comprising a fixed electrode and a movable electrode which may be separated from each other;

a movable shaft moving together with said movable electrode;

a movable body fixedly mounted on said movable shaft;

a fixed body disposed opposite said movable body, said movable shaft passing through and being slidable relative to said fixed body;

a coil for separating said movable body from said fixed body in response to an electromagnetic force generated by passage of an electrical current through the coil; and slits, for suppressing eddy currents, in at least one of opposing surfaces of said movable body and said fixed body.

10. The switching assembly according to claim 9 wherein the slits on said opposing surface occupy no more than twenty percent of said surface.

11. The switching assembly according to claim 9 including slits extending longitudinally along one half to one quarter of a total length of said fixed body, in a side surface of said fixed body, perpendicular to said opposing surface of said fixed body.

12. The switching assembly according to claim 9 including slits extending longitudinally along one half to one quarter of a total length of said movable body, in a side surface of said movable body, perpendicular to said opposing surface of said movable body.

13. The switching assembly according to claim 9 wherein said movable body has an I-shaped cross section.

14. The switching assembly according to claim 9 wherein said movable body has an E-shaped cross section.

15. The switching assembly according to claim 9 wherein said movable body has a T-shaped cross section integrated with said movable shaft.

16. The switching assembly according to claim 9 wherein said fixed body has an E-shaped cross section.

17. The switching assembly according to claim 9 wherein said fixed body has a cylindrical shape.

18. The switching assembly according to claim 9 wherein:

said fixed body comprises a first fixed body and a second fixed body disposed on opposite sides of said movable body, said movable shaft passing through a central portion of said movable body; and said coil comprises a first coil disposed inside said first fixed body and a second coil disposed inside said second fixed body.

19. The switching assembly according to claim 9 wherein said movable shaft and said movable body are integral and the same material.

* * * * *